US010271578B2

(12) United States Patent
John et al.

(10) Patent No.: US 10,271,578 B2
(45) Date of Patent: Apr. 30, 2019

(54) AEROSOL GENERATING MATERIAL AND DEVICES INCLUDING THE SAME

(71) Applicant: BRITISH AMERICAN TOBACCO (INVESTMENTS) LIMITED, London (GB)

(72) Inventors: Edward John, London (GB); Jason Symonds, London (GB); Walid Abi Aoun, London (GB)

(73) Assignee: British American Tobacco (Investments) Limited, London (GB)

( * ) Notice: Subject to any disclaimer, the term of this patent is extended or adjusted under 35 U.S.C. 154(b) by 140 days.

(21) Appl. No.: 15/036,318

(22) PCT Filed: Nov. 14, 2014

(86) PCT No.: PCT/GB2014/053384
§ 371 (c)(1),
(2) Date: May 12, 2016

(87) PCT Pub. No.: WO2015/071682
PCT Pub. Date: May 21, 2015

(65) Prior Publication Data

US 2016/0295922 A1 Oct. 13, 2016

(30) Foreign Application Priority Data

Nov. 15, 2013 (GB) ..... 1320231.2

(51) Int. Cl.
*A24F 47/00* (2006.01)
*H05B 3/18* (2006.01)
(Continued)

(52) U.S. Cl.
CPC ..... *A24F 47/008* (2013.01); *A24B 15/16* (2013.01); *B05D 7/24* (2013.01); *H05B 3/10* (2013.01); *H05B 2203/017* (2013.01)

(58) Field of Classification Search
CPC ..... A24F 47/00; A24F 47/008
See application file for complete search history.

(56) References Cited

U.S. PATENT DOCUMENTS 4,735,217 A 4/1988 Gerth et al.
4,947,874 A 8/1990 Brooks et al.
(Continued)

FOREIGN PATENT DOCUMENTS

CA 2853569 A1 5/2013
CN 1102964 5/1995
(Continued)

OTHER PUBLICATIONS

Canadian Office Action, Application No. 2,929,379, dated Apr. 21, 2017, 5 pages.
(Continued)

*Primary Examiner* — Michael A Laflame, Jr.
(74) *Attorney, Agent, or Firm* — Patterson Thuente Pedersen, P.A.

(57) ABSTRACT

There is provided a device for generating an inhalable aerosol and/or gas, the device comprising an aerosol generating material (3) having an integrated electrical resistance heating element (2), so that the aerosol generating material may be heated in direct contact with the electrical resistance heating element, wherein the aerosol generating material is provided as a unitary structure and/or coating which may be heated to generate multiple deliveries of an inhalable aerosol and/or gas. There is also provided a method for fabricating the device. There is also provided the use of the device and the use of the aerosol generating material, to generate an inhalable aerosol and/or gas.

28 Claims, 9 Drawing Sheets

(51) Int. Cl.

| | |
|---|---|
| ***H05B 3/40*** | (2006.01) |
| ***A24B 15/16*** | (2006.01) |
| ***B05D 7/24*** | (2006.01) |
| ***H05B 3/10*** | (2006.01) |

(56) References Cited

U.S. PATENT DOCUMENTS

| | | | | |
|---|---|---|---|---|
| 5,060,671 | A | 10/1991 | Counts | |
| 5,093,894 | A | 3/1992 | Deevi et al. | |
| 5,179,966 | A | 1/1993 | Losee et al. | |
| 5,322,075 | A | 6/1994 | Deevi et al. | |
| 5,388,594 | A | 2/1995 | Counts et al. | |
| 5,666,978 | A | 9/1997 | Counts et al. | |
| 2007/0102013 | A1 | 5/2007 | Adams et al. | |
| 2008/0092912 | A1 | 4/2008 | Robinson et al. | |
| 2011/0253135 | A1 | 10/2011 | Hale et al. | |
| 2012/0060853 | A1 | 3/2012 | Robinson et al. | |
| 2013/0037041 | A1 | 2/2013 | Worm et al. | |
| 2013/0284192 | A1 | 10/2013 | Peleg | |
| 2015/0150302 | A1* | 6/2015 | Metrangolo ..... | A24B 13/00 131/77 |
| 2015/0164143 | A1 | 6/2015 | Maas | |
| 2016/0044963 | A1 | 2/2016 | Saleem | |

FOREIGN PATENT DOCUMENTS

| | | | |
|---|---|---|---|
| CN | 200983831 | | 12/2007 |
| EP | 0 418 465 | A2 | 3/1991 |
| EP | 0 430 559 | A2 | 6/1991 |
| EP | 0430559 | | 6/1991 |
| EP | 0640297 | A1 | 3/1995 |
| EP | 0 703 735 | B1 | 7/2001 |
| EP | 0 822 760 | A1 | 6/2003 |
| EP | 2 316 286 | A1 | 5/2011 |
| EP | 2 338 361 | A1 | 6/2011 |
| EP | 2 340 729 | A1 | 7/2011 |
| EP | 2 340 730 | A1 | 7/2011 |
| EP | 2 368 449 | A1 | 9/2011 |
| EP | 2 412 396 | A1 | 2/2012 |
| EP | 2 460 424 | A1 | 6/2012 |
| EP | 2 724 630 | A1 | 4/2014 |
| FR | 2 985 886 | | 7/2013 |
| GB | 2504076 | A | 1/2014 |
| KR | 10-0178387 | | 2/1999 |
| KR | 10-0178388 | | 2/1999 |
| WO | WO 2006/047663 | A2 | 5/2006 |
| WO | WO 2007/042941 | A2 | 4/2007 |
| WO | WO 2012/085203 | A1 | 6/2012 |
| WO | WO 2013022936 | A1 | 2/2013 |
| WO | WO 2013/034454 | | 3/2013 |
| WO | WO 2013/034454 | A1 | 3/2013 |
| WO | WO 2013/083635 | A1 | 6/2013 |
| WO | WO 2013/098395 | A1 | 7/2013 |
| WO | WO 2013/098410 | A2 | 7/2013 |
| WO | WO 2015071682 | | 5/2015 |

OTHER PUBLICATIONS

Japanese Office Action, Application No. 2016-530896, dated Jun. 27, 2017 , 3 pages (6 pages with translation).

Korean Office Action, Application No. 10-2016-7012761, dated Sep. 14, 2017, 10 pages (25 pages with translation).

philly.com, "Coming: A nearly smokeless cigarette R.J. Reynolds' process will heat tobacco rather than burn it," Posted on Sep. 15, 1987 <<http://articles.philly.com/1987-09-15/news/26207695_1_flavorings-and-glycerin-cigarette-smoke-smokeless-cigarette>> Retrieved on Sep. 10, 2014.

International Search Report for corresponding International App No. PCT/GB2014/053384 dated Mar. 10, 2015; 5 pages.

Written Opinion for corresponding International App No. PCT/GB2014/053384 dated Mar. 10, 2015; 5 pages.

Chinese Office Action, Application No. 201480073324.6, dated Aug. 23, 2018, 7 pages (18 pages with translation).

A Collection of Translated Essays in Smoking and Health, National Tobacco Industry Science and Technology Information Station, pp. 265-266 (Light Industry Press, Feb. 1986).

Li Dongguang, Practical Chemical Product Formulation and Preparation, China Textile Press (Mar. 2013, pp. 298-299).

English translation of Chinese Office Action, Application No. 201480073324.6, dated Apr. 8, 2018, 15 pages.

Chinese Search Report, Application No. 2014800733246, dated Feb. 6, 2018, 2 pages.

Korean Office Action, Application No. 10-2018-7033346, dated Dec. 17, 2018, 6 pages.

* cited by examiner

AEROSOL GENERATING MATERIAL AND DEVICES INCLUDING THE SAME

PRIORITY CLAIM

The present application is a National Phase entry of PCT Application No. PCT/GB2014/053384, filed Nov. 14, 2014, which claims priority from GB Patent Application No. 1320231.2, filed Nov. 15, 2013, each of which is hereby fully incorporated herein by reference.

FIELD

The present disclosure relates to aerosol generating material which emits an aerosol and/or gas on heating.

BACKGROUND

Tobacco material is heated in smoking articles for the purpose of releasing substances contained in the material and delivering these as an aerosol.

In many smoking articles, the heat providing the thermal energy needed to release a smoke aerosol from the tobacco material is provided via the physico-chemical degradation processes that occur during combustion, which may be a combination of oxidative degradation, pyrolysis, pyrosynthesis, and distillation. The thermal energy generated by combustion tends to be high, however, and the amount of heat released is often difficult to control.

SUMMARY

According to a first aspect, there is provided a device for generating an inhalable aerosol and/or gas, the device comprising an aerosol generating material having an integrated electrical resistance heating element, so that the aerosol generating material may be heated in direct contact with the electrical resistance heating element, wherein the aerosol generating material is provided as a unitary structure and/or coating which may be heated to generate multiple deliveries of an inhalable aerosol and/or gas.

In some embodiments, the aerosol generating material may be repeatedly heated by the heating element to generate deliveries of inhalable aerosol and/or gas.

In some embodiments, the aerosol generating material comprises an aerosol generating agent.

In some embodiments, the aerosol generating material comprises nicotine.

In some embodiments, the aerosol generating material comprises tobacco material.

In some embodiments, the aerosol generating material comprises an inorganic filler material.

In some embodiments, the aerosol generating material comprises a binder.

In some embodiments, at least part of the electrical resistance heating element is in the form of a mesh or a coil.

In some embodiments, at least part of the electrical resistance heating element is at least partially embedded in, or coated by, the aerosol generating material.

In some embodiments, at least part of the aerosol generating material is at least partially surrounded by the electrical resistance heating element.

In some embodiments, a first portion of the aerosol generating material may be heated independently from a second portion of the aerosol generating material by the electrical resistance heating element.

In some embodiments, the first portion and the second portions have different chemical compositions.

In some embodiments, at least one portion of the aerosol generating material must be moved from a first position to a second position in order to be heated by the electrical resistance heating element.

In some embodiments, the heating of the aerosol generating material by the electrical resistance heating element is to be initiated and/or controlled by the user of the device.

In some embodiments, the device is a heat-not-burn device.

According to a second aspect, there is provided a method for fabricating a device for generating an inhalable aerosol and/or gas according to the first aspect, wherein the method comprises applying a slurry of aerosol generating material to an electrical resistance heating element.

In some embodiments, the slurry is applied by casting the slurry onto the electrical resistance heating element. In some embodiments, the slurry is applied by dipping the electrical resistance heating element into the slurry. In some embodiments, the slurry is extruded with or onto the electrical resistance heating element.

According to a third aspect, there is provided the use of a device according to the first aspect for the generation of an aerosol and/or gas comprising nicotine.

According to a fourth aspect, there is provided the use of an aerosol generating material as defined in the first aspect for the generation of an aerosol and/or gas comprising nicotine by heating the material in direct contact with an electrical resistance heating element.

According to a fifth aspect, there is provided a composite structure comprising an electrical resistance heating element, which is at least partially embedded in, or coated by, an aerosol generating material, wherein the material is in direct contact with the electrical resistance heating element and may be heated to generate multiple deliveries of an inhalable aerosol and/or gas.

In some embodiments, the electrical resistance heating element is a mesh.

In some embodiments, the composite structure may be moved to heat different portions of the structure.

In some embodiments, different portions of the composite structure may be heated independently by separate power sources or by switching the supply of power from one portion to another.

In some embodiments, the composite structure is in the form of an elongate ribbon or band.

In some embodiments, the composite structure comprises an aerosol generating material as defined in the first aspect of the invention.

According to a sixth aspect, there is provided an article comprising a composite structure according to the fifth aspect of the invention, and a means for moving the composite structure to allow different portions thereof to be heated.

In some embodiments, the composite structure is in the form of an elongate ribbon or band and the means for moving it is a spool.

BRIEF DESCRIPTION OF DRAWINGS

Embodiments will now be described, by way of example only, with reference to accompanying drawings, in which.

DETAILED DESCRIPTION

Figure 1:
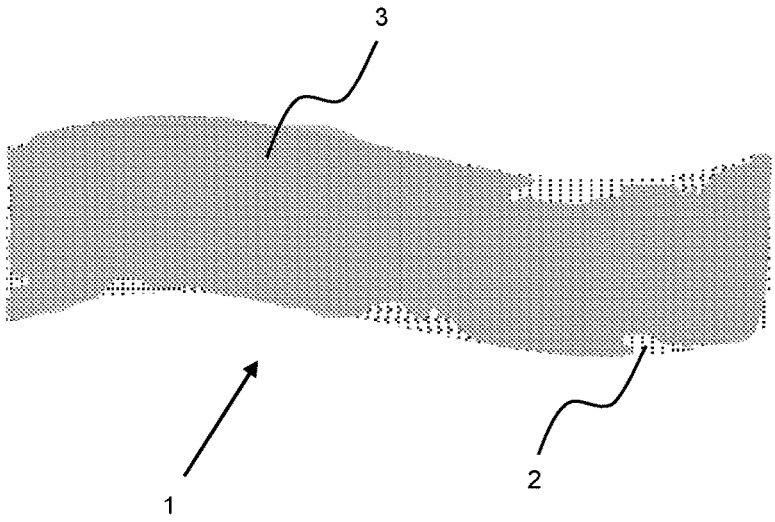
FIG. 1 is a schematic illustration of aerosol generating material coated onto a metal mesh heating element according to one embodiment (not drawn to scale).

The present disclosure relates to devices for forming an inhalable aerosol and/or gas, the devices comprising aerosol generating material that may be heated to emit an inhalable aerosol. More specifically, the present disclosure relates to devices comprising aerosol generating material in contact with a heat source which is an electrical resistance heating element.

The aerosol generating material has an integrated electrical resistance heating element, so that the aerosol generating material and heating element form a single unit or composite structure. In some embodiments, the electrical resistance heating element is at least partially embedded in or coated by the aerosol generating material. In some embodiments, the electrical resistance heating element at least partially surrounds the aerosol generating material.

In some embodiments, the heating of the aerosol generating material does not result in any significant combustion of the material. In some embodiments, the heating results in no combustion or essentially no combustion of the aerosol generating material.

Using electricity to heat aerosol generating material in a smoking article has many advantages. In particular, it has many advantages over using combustion.

Combustion is a complex process that generates aerosols by a combination of interactive physico-chemical processes which may include oxidative degradation, pyrolysis, pyrosynthesis, and distillation. It generally leads to the generation of complex aerosols. For example, smoke arising from a combustible smoking article comprising tobacco is a complex, dynamic mixture of more than 5000 identified constituents.

The exothermic processes of combustion may be self-sustaining, and may result in heat generation rates, and heat output quantities, sufficient for degradation of the combustible matrix. In some cases, the matrix may be completely degraded to an ash residue which may comprise inorganic, non-combustible materials. Very high temperatures can be reached in burning cigarettes due to the exothermic reaction of combustion. In between taking puffs of a cigarette (the inter-puff smoldering period), the center of the burning zone in the tobacco rod of the cigarette can reach temperatures as high as 800° C. During taking a puff of a cigarette, the periphery of the burning zone in the tobacco rod of the cigarette can reach temperatures as high as 910° C.

Using electrical resistance heating systems is advantageous because the rate of heat generation is easier to control, and lower levels of heat are easier to generate, compared to when using combustion.

The use of electrical heating systems therefore allows greater control over the generation of an aerosol and/or gas from aerosol generating materials. Furthermore, it allows for aerosol and/or gas to be generated without combustion taking place, rather than through combustive degradation. Electrical heating systems can also facilitate the generation of an aerosol and/or gas from inherently non-combustible materials, such as inorganic sorbents with ingredients that generate an aerosol and/or gas when heated.

In the devices of embodiments, the electrical resistance heating element provides a medium for conducting electricity and generating heat. When an electric current passes through the element, the temperature of the element increases, and the aerosol generating material in contact with it is heated.

Raising the temperature of the aerosol generating material may have any suitable effect on the aerosol generating material. In some embodiments, it may lead to the generation of a gas and/or aerosol. In some embodiments, raising the temperature of the aerosol generating material may result in the formation of a gas and/or aerosol which has desirable sensory characteristics and/or comprises nicotine.

The effect delivered by the aerosol generating material when heated by the heating element will depend on the chemical composition of the aerosol generating material, as well as the temperature to which it is heated.

The aerosol generating material included in the devices of embodiments may have any suitable chemical composition.

The devices of embodiments are able to provide multiple deliveries or doses of aerosol and/or gas. This means that the aerosol generating material may be heated to produce sufficient aerosol and/or gas to allow multiple puffs. This may be achieved by heating the aerosol generating material for a period of time sufficient to produce a volume of aerosol and/or gas suitable for multiple deliveries. In some embodiments, this may involve heating the aerosol generating material constantly. Alternatively, this may involve successive, shorter periods of heating the aerosol generating material, optionally with each period producing a single delivery or dose of aerosol and/or gas. In the latter embodiments, the same aerosol generating material may be repeatedly heated by the same heating element to produce multiple deliveries or doses of aerosol and/or gas.

In some embodiments, the devices include aerosol generating material in the form of a unitary structure. This means that the material is provided as a single piece or item. This unitary structure may, for example, be extruded, cast or molded. The structure or coating may be formed from a slurry which is dried to provide the aerosol generating material in a solid form. In some embodiments, the slurry is dried in contact with the heating element so that the aerosol generating material is in a solid form and adheres to the heating element.

In some embodiments, the aerosol generating material may comprise an aerosol generating agent. In this context, an "aerosol generating agent" is an agent that promotes the generation of an aerosol. An aerosol generating agent may promote the generation of an aerosol by promoting the sublimation of a gas to a solid, or the condensation of a gas to a liquid. In some embodiments, an aerosol generating agent may improve the delivery of flavor from the aerosol generating material.

Any suitable aerosol generating agent or agents may be included in the aerosol generating material of embodiments. Suitable aerosol generating agents include, but are not limited to: a polyol such as sorbitol, glycerol, and glycols like propylene glycol or triethylene glycol; a non-polyol such monohydric alcohols, high boiling point hydrocarbons, acids such as lactic acid, glycerol derivatives, esters such as diacetin, triacetin, triethylene glycol diacetate, triethyl citrate or isopropyl myristate and aliphatic carboxylic acid esters such as methyl stearate, dimethyl dodecanedioate and dimethyl tetradecanedioate.

Any suitable quantity and concentration of aerosol generating agents may be included in the aerosol generating material. In some embodiments, the quantity and concentration of an aerosol generating agent may be used as a means for controlling the amount of aerosol and/or gas generated by the material on heating. In some embodiments, a greater quantity and concentration of an aerosol generating agent may be included in the material so that a greater quantity of aerosol and/or gas is generated on heating.

In some embodiments, the aerosol generating material may comprise between about 5-50% or 10-20% aerosol generating agent by weight. In some of these embodiments, the aerosol generating agent may be glycerol. In some embodiments, it may be advantageous for the aerosol generating material to comprise between about 10-30% or 20-40% aerosol generating agent by weight. In some of these embodiments, the aerosol generating agent may be glycerol.

In some embodiments, the aerosol generating material may comprise one or more compounds for the purpose of lowering the boiling point of one or more other substances in the aerosol generating material. In some of these embodiments, the aerosol generating material may comprise one or more compounds for the purpose of forming an azeotrope with one or more other substances in the aerosol generating material.

In some embodiments, the aerosol generating material may comprise one or more flavorants. As used herein, the terms "flavor" and "flavorant" refer to materials which, where local regulations permit, may be used to create a desired taste or aroma in a product for adult consumers.

They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, coconut oil, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or simulators, sugars and/or sugar substitutes (e.g., sucralose, acesulfame, potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients, or blends thereof. They may be in any suitable form, for example, oil, liquid, or powder.

In embodiments wherein the aerosol generating material comprises one or more flavorants, it may be advantageous for the material to comprise a quantity and concentration of flavorants suitable for delivering desirable quantities of them to the aerosol and/or gas generated from the aerosol generating material. In some embodiments, a desirable quantity may be a quantity that results in a superior sensory experience for the adult consumer of the devices.

In some embodiments, the aerosol generating material may comprise nicotine. In some embodiments, it may be advantageous for the material to comprise a quantity and concentration of nicotine suitable for delivering desirable quantities of nicotine in the aerosol and/or gas generated when the aerosol generating material is heated.

In some embodiments, the aerosol generating material releases nicotine in a more controlled and efficient manner compared to when it is released in conventional, combustible cigarettes. With conventional cigarettes, nicotine is released in between taking puffs because the tobacco continues to burn. However, in some embodiments, in the devices, the aerosol generating material may only be heated when desired, which may be when inhaling the aerosol and/or gas generated in the device.

In some embodiments, the aerosol generating material may comprise more than about 1%, 2%, 3%, 4%, 5%, 6%, 7%, 8%, 9%, or 10% nicotine by weight. In some embodiments, the material may comprise less than about 25%, 20%, 15%, 10%, or 5% nicotine by weight. In some embodiments, the material may comprise about 4% nicotine by weight.

In some embodiments, the aerosol generating material may comprise tobacco material, wherein tobacco material is any material comprising tobacco or derivatives thereof. In some embodiments, the aerosol generating material may comprise a tobacco substitute.

The tobacco used in the aerosol generating material or treated to produce tobacco material, such as a tobacco extract, for use in the aerosol generating material may be any suitable tobacco, such as single grades or blends, cut rag or whole leaf, including Virginia and/or Burley. It may also be tobacco particle 'fines' or dust, expanded tobacco, stems, expanded stems, and other processed stem materials, such as cut rolled stems.

In embodiments where the aerosol generating material comprises tobacco material, the tobacco material may have any suitable chemical composition and may have been prepared according to any suitable process. In some embodiments, the tobacco material may comprise one or more substances in the solid and/or liquid phase. In these embodiments, the tobacco material may have any suitable solid and liquid content.

In some embodiments, the tobacco material may comprise more than about 1%, 2%, 3%, 4%, 5%, 6%, 7%, 8%, 9%, or 10% nicotine by weight. In some embodiments, the tobacco material may comprise less than about 25%, 20%, 15%, 10%, or 5% nicotine by weight. In some embodiments, the tobacco material may comprise about 4% nicotine by weight.

In some embodiments, the tobacco material may comprise a tobacco extract. A tobacco extract is a composition of tobacco that is obtained by a method comprising the treatment of tobacco with a solvent, along with any other suitable extraction processes.

In some embodiments, the tobacco extract may be obtained by a method comprising the treatment of tobacco with water. In some embodiments, the treatment of tobacco with water may comprise adding water to tobacco, separating the resulting water-based liquid extract from the insoluble portion of tobacco feedstock, and optionally removing excess water to form a tobacco extract. Any suitable filtration methods may be used, such as centrifugal solids filtration or vacuum fluidized bed filtration. Any suitable evaporative concentration methods may be used, such as vacuum spinning disk, vacuum falling, or rising film evaporation. Such processes would be known to those skilled in the art of filtration and evaporative concentration.

In some embodiments, the tobacco extract may be prepared by a method comprising steps for removing or reducing the concentration of certain substances. For example, the tobacco extract may be treated with bentonite to reduce protein content, and/or polyvinylpolypyrrolidone to reduce polyphenol content.

In some embodiments, the tobacco extract may be prepared by a method comprising steps for adding or increasing the concentration of one or more substances. In some of these embodiments, aerosol generating agents and/or flavorants may be added, for example.

A tobacco extract included in the aerosol generating material in the devices of embodiments may have any suitable chemical composition. It may have any suitable solid and liquid content. The solid content of the tobacco extract may have a significant effect on the structural stability of the aerosol generating material when added to the electrical resistance heating element, and may have a significant effect on how the material is affected when heated.

Experiments have shown that aerosol generating material prepared by drying a slurry of aerosol generating material comprising tobacco extract with a solid content of about 55% is suitable for embodiments. Details of these experiments are provided in the Examples section below. In some embodiments, the aerosol generating material may be prepared by drying a slurry of the aerosol generating material comprising a tobacco extract with a solid content of at least about 40%, 45%, 50%, 55%, 60%, 65%, 70%, 75%, 80%, 85%, 90%, 95%, or 99%. In some embodiments, the aerosol generating material may be prepared by drying a slurry of aerosol generating material comprising a tobacco extract with a solid content of about 55%.

In some embodiments, the aerosol generating material may comprise any suitable substances in place of, or in addition to, a tobacco extract. Examples of suitable substances include, but are not limited to: water, a binder, an inorganic filler material, and an aerosol generating agent. In some embodiments, such substances may be added to the aerosol generating material during the process of preparing a reconstituted tobacco material. In some embodiments, such substances may be added to the aerosol generating material by a process comprising impregnation of the tobacco material.

In some embodiments, the aerosol generating material may comprise one or more inorganic filler materials. The aerosol generating material may comprise any suitable inorganic filler materials. Suitable inorganic filler materials include, but are not limited to: calcium carbonate (i.e. chalk), perlite, vermiculite, diatomaceous earth, colloidal silica, magnesium oxide, magnesium sulphate, magnesium carbonate, and suitable inorganic sorbents, such as molecular sieves.

An inorganic filler material may be included in the aerosol generating material for any suitable purpose. In some embodiments, it may act as a sorbent and/or support for other substances in the aerosol generating material. In some embodiments, it may act as a structure for adsorbing other substances before releasing them on heating. In some embodiments, it may act as a sorbent and/or support for an aerosol generating agent, such as glycerol, and/or any other substances that influence the sensory characteristics of the aerosol generated on heating.

In some embodiments, an inorganic filler material may be included in the aerosol generating material to provide additional strength. In some embodiments, it may be included together with a tobacco extract, in which case it may be included to help hold the tobacco extract together and/or provide additional strength to it.

An inorganic filler material may be included in the aerosol generating material in any suitable quantity and concentration. In some embodiments, it may be advantageous to include a large quantity and concentration of inorganic filler material in the aerosol generating material to increase its strength. In some embodiments, the aerosol generating material may comprise between about 1-90%, 45-95%, 50-90%, 55-85%, 60-80%, or 65-75% inorganic filler material by weight. In some of these embodiments, the inorganic filler material may be chalk.

In some embodiments, the aerosol generating material may comprise one or more binders. The aerosol generating material may comprise any suitable binder. In some embodiments, the binder comprises one or more of an alginate, celluloses or modified celluloses, starches or modified starches, and natural gums.

Suitable binders include, but are not limited to: alginate salts comprising any suitable cation, such as sodium alginate, calcium alginate, and potassium alginate; celluloses or modified celluloses, such as hydroxypropyl cellulose and carboxymethylcellulose; starches or modified starches; pectin salts comprising any suitable cation, such as sodium pectate; xanthan gum, guar gum, and any other suitable natural gums.

A binder may be included in the aerosol generating material in any suitable quantity and concentration. The quantity and concentration of the binder included in the material may vary depending on the composition of the material, the nature of the heat source, for example the electrical resistance heating element, and the properties desired of the device into which it is incorporated.

In some embodiments, the aerosol generating material may comprise between about 3-50%, 5-40%, 10-35%, or 15-30% binder by weight. In some of these embodiments, the binder may be sodium alginate. In some embodiments, it may be advantageous for the material to comprise between about 20-25% binder by weight. In some of these embodiments, the binder may be sodium alginate.

In some embodiments, the aerosol generating material may comprise water. Water may be included for any suitable purpose, and may be included having been purified using any suitable method of purification, such as reverse osmosis, distillation, and/or ion exchange. In some embodiments, it may be included to moisten the material. Alternatively or in addition, it may be included to modify the sensory characteristics of the aerosol and/or gas generated from the material on heating.

Any suitable quantity of water may be included in the aerosol generating material. For example, some inorganic-based aerosol generating materials may comprise between about 3-10% water. For example, some tobacco-based aerosol generating materials may comprise between about 10-15% water.

In some embodiments, as discussed in greater detail below, the aerosol generating material may be applied to the heat source in the form or a slurry which is dried to form a solid coating or layer, or monolithic form. The slurry may include water, some of which is removed as the slurry dries.

In some embodiments, the aerosol generating material may comprise one or more of the following in any possible combination: an aerosol generating agent, such as glycerol; an inorganic filler material, such as chalk; a binder, such as sodium alginate; a flavorant, nicotine, and water.

In some embodiments, the aerosol generating material may comprise heat-conducting particles. These may improve the rate of heat transfer from the electrical resistance heating element to the aerosol generating material. Alternatively or in addition, they may improve the rate of heat transfer from one region of the aerosol generating material to another region of the aerosol generating material.

The following discussion of the slurry and of the parameters for all of the components relate to the possible amounts and/or concentrations of the components in the slurry for making an aerosol generating material (rather than referring to the components of the resultant aerosol generating material, unless otherwise stated).

As used herein, a slurry is a liquid, gel, solution, suspension or emulsion. It does not necessarily include solid particles of matter. It is, in some embodiments, in a form which may be readily applied to the surface of a heat source so that, upon drying, it forms a coating or encases the heat source.

Thus, in some embodiments, the slurry has a consistency and/or water content that renders it suitable for casting or dipping or spraying onto a heat source. In further embodiments, the slurry may have a consistency and/or water content that renders it suitable for extrusion, for example to form a rod of aerosol generating material around which the heat source may be placed or formed.

In some embodiments, the aerosol generating material may be prepared by drying a slurry comprising between about 30-80%, 40-70%, or 50-60% tobacco material by weight. In some embodiments, the aerosol generating material may be prepared by drying a slurry comprising about 55% tobacco material by weight.

In some embodiments, the aerosol generating material may be prepared by drying a slurry comprising between about 30-80%, 40-70%, or 50-60% tobacco extract by weight. In some embodiments, the aerosol generating material may be prepared by drying a slurry comprising about 55% tobacco extract by weight.

In some embodiments, the aerosol generating material may be prepared by drying a slurry comprising between about 1-40%, 2-18%, 4-16%, 6-14%, or 8-12% binder by weight. In some of these embodiments, the binder may be sodium alginate. In some embodiments, it may be advantageous for the aerosol generating material to be prepared by drying a slurry comprising about 10% binder by weight. In some of these embodiments, the binder may be sodium alginate.

In some embodiments, the aerosol generating material may be prepared by drying a slurry comprising between about 10-50%, 15-45%, 20-40%, or 25-35% water by weight. In some embodiments, it may be advantageous for the aerosol generating material to be prepared by drying a slurry comprising about 30% water by weight.

In some embodiments, the aerosol generating material may be prepared by drying a slurry comprising between about 1-40%, 2-15%, 3-10%, or 4-6% aerosol generating agent by weight. In some of these embodiments, the aerosol generating agent may be glycerol. In some embodiments, it may be advantageous for the aerosol generating material to be prepared by drying a slurry comprising about 5% aerosol generating agent by weight. In some of these embodiments, the aerosol generating agent may be glycerol.

Experiments have shown that aerosol generating material prepared by drying a slurry comprising about 340 g tobacco extract, 60 g sodium alginate, 200 g water, and 35 g glycerol has properties suitable for use as the aerosol generating material in the devices of the invention. Details of these experiments are provided under the Examples section below. An aerosol generating material prepared by drying a slurry comprising these substances in the same, or similar, ratios may therefore be suitable for the devices of the invention.

In some embodiments, the aerosol generating material may be prepared by drying a slurry whose solid content comprises between about 35-95%, 40-90%, 45-85%, 50-80%, 55-75%, or 60-70% tobacco extract by weight. In some embodiments, the aerosol generating material may be prepared by drying a slurry whose solid content comprises about 65% tobacco extract by weight.

In some embodiments, the aerosol generating material may be prepared by drying a slurry whose solid content comprises between about 5-35%, 10-30%, or 15-25% binder by weight. In some of these embodiments, the binder may be sodium alginate. In some embodiments, the aerosol generating material may be prepared by drying a slurry whose solid content comprises about 20% binder by weight. In some of these embodiments, the binder may be sodium alginate.

In some embodiments, the aerosol generating material may be prepared by drying a slurry whose solid content comprises between about 5-20% or 10-15% aerosol generating agent by weight. In some of these embodiments, the aerosol generating agent may be glycerol. In some embodiments, the aerosol generating material may be prepared by drying a slurry whose solid content comprises about 13% aerosol generating agent by weight. In some of these embodiments, the aerosol generating agent may be glycerol.

Experiments have shown that aerosol generating material prepared by drying a slurry whose solid content comprises about 65% tobacco extract by weight, 20% sodium alginate by weight, and 13% glycerol by weight has properties suitable for use as the aerosol generating material in the devices of the invention. Details of these experiments are provided under the Examples section below. An aerosol generating material prepared by drying a slurry with this solid content, or similar, may therefore be suitable for the devices.

In some embodiments, additional ingredients may be included in the aerosol generating material for amelioration of sensory characteristics of the aerosols generated. In some cases, water, flavorings, casings, or substances which may be acidic or basic in character may alter the taste, flavor, and sensory impact of the aerosol. In some embodiments, these additional ingredients may lead to a milder or mellow effect. In some embodiments, they may lead to more pronounced sensory effects.

The aerosol generating material may be heated to any suitable temperature by the heat source, such as an electrical resistance heating element, in the devices of embodiments. The aerosol generating material may be heated to a particular temperature for the purpose of delivering a particular experience.

In some embodiments, the aerosol generating material may be heated to a temperature sufficient to significantly increase the rate of evaporation and/or sublimation of a substance in the aerosol generating material, but insufficient to initiate combustion. This may be the case when the devices of embodiments are heat-not-burn devices. In some embodiments, the aerosol generating material may be heated to a temperature sufficient to initiate combustion. This may be the case when the device is a combustible device.

In some embodiments, the device may be configured to heat the aerosol generating material to a temperature of between about 50-400° C., 100-350° C., 150-350° C., 150-330° C., or 180-300° C.

The temperature to which the aerosol generating material is heated in the devices of the invention will depend on the properties of heat source. For example, an electrical resistance heating element heats the aerosol generating material in the devices of the invention. It does this by providing a conducting medium that resists the flow of electricity and, in so doing, transduces electrical energy into thermal energy.

One or more electrical resistance heating elements may be included in the devices of embodiments. In embodiments wherein more than one heating element is included, each one may be the same or may be different.

The electrical resistance heating element may comprise any suitable conducting medium. In some embodiments, the electrical resistance heating element comprises a metal or metal alloy. It may be advantageous for the electrical resistance heating element to comprise a metal or metal alloy because metals are excellent conductors of electricity and thermal energy.

Suitable metals include but are not limited to: copper, aluminum, platinum, tungsten, gold, silver, and titanium. Suitable metal alloys include but are not limited to: nichrome and stainless steel. Stainless steel has been shown to be effective in experiments, as discussed in the Examples section below.

In some embodiments, the metal or metal alloy may be coated in another material which is more resistant to corrosion than the metal or metal alloy. In some embodiments, this material may also be a metal or metal alloy, such as gold or silver.

An electrical resistance heating element used in the devices of embodiments may have any suitable size and shape. In some embodiments, it may be advantageous for the shape of the heating element to have a large surface area to volume ratio in order to promote the dissipation of thermal energy, and the heating of the aerosol generating material. The heating element may have any suitable shape and may include, by way of illustrative examples only: straight or linear wires; flat sheets; bent or curved wires, for example in the form of a coil or spiral; and shaped or non-flat sheets, for example folded sheets in the form of a zigzag or corrugated sheets. Sheets may be solid or include perforations, such as a sheet with one or more holes.

In some embodiments, at least part of the electrical resistance heating element is in the form of a mesh. In some embodiments, at least part of the heating element is in the form of a metal mesh. A mesh has a large surface area to volume ratio. A mesh also, advantageously, covers a large surface are with a small amount of material.

In embodiments wherein the heating element is a mesh or metal mesh, it may be flat or substantially flat. This flat mesh may have any suitable dimensions. In some embodiments, it may be elongate or rectangular. In some embodiments, the flat mesh may be rectangular with a width of between about 0.3-2 cm, or 0.75-1.25 cm. In some embodiments, the flat mesh may be rectangular with a length of between about 3-6 cm, or 4-5 cm. In some embodiments, the flat sheet may be rectangular with a width of about 1 cm and a length of about 5 cm. In some embodiments, the mesh is narrow and elongate in form, like a ribbon or similar.

In some embodiments wherein the heating element comprises a mesh, it may be substantially flat when incorporated into the devices of the present invention. In other embodiments, the mesh may be wrapped so that it forms a wound configuration and, in some cases, the wound configuration may be cylindrical in shape.

In some embodiments the aerosol generating material is coated onto a mesh to form a sheet. In some embodiments, the sheet is flat or substantially flat. In other embodiments, the sheet is wrapped into a wound configuration. In some embodiments, the wound sheet may be unwound by the user of the device. In some embodiments, the sheet may be unwound in order to reveal fresh aerosol generating material which has not yet been heated. In some embodiments, the sheet may be unwound to reveal fresh aerosol generating material after the material which has already been exposed has already been heated. This may increase the amount of material which can be heated and so extend the length of time over which the device may be used.

In embodiments wherein the aerosol generating material is coated onto a mesh to form a sheet, and wherein the sheet is wrapped into a wound configuration, the sheet may be wrapped around a spool. The spool may make it easier to unwind the sheet. In some embodiments, the spool may have a cylindrical shape.

In some embodiments, the sheet may comprise portions of aerosol generating material which may be independently heated. In some embodiments, the adjacent portions of the sheet, comprising the aerosol generating material and electrical resistance heating element, are separated by insulating means.

In some embodiments, at least part of the electrical resistance heating element is in the form of a coil. In some embodiments, at least part of the heating element is in the form of a metal coil.

In some embodiments, the aerosol generating material is coated onto the surface or a least part of the surface of the coil.

In some alternative embodiments, the coil or cylindrical heating element (for example, formed from a mesh) surrounds the aerosol generating material which is in a monolithic form. For example, the aerosol generating material may be extruded into a rod or cylinder form. In some embodiments, the heat source contacts the aerosol generating material to heat it. In such embodiments, the aerosol generating material may be moved and/or replaced to enable the heat source to heat fresh aerosol generating material.

In embodiments wherein the heating element comprises a metal mesh and/or metal coil an important property of the heating element may be the diameter or gauge of the individual strands of metal. This is because the diameter of the strands affects their ability to conduct electricity and the heat which they dissipate when electricity passes through them. In some embodiments, the heating element may comprise metal strands whose diameter is most appropriate for the rate of heat generation which is desired in the devices. In some embodiments, a smaller diameter may be preferred over a larger diameter because a smaller diameter tends to emit heat at a faster rate than a larger diameter when the same electric current passes through.

The electrical conductivity and thermal conductivity of the heating element is crucial for its function. It may have any suitable electrical and thermal conductivity, as long as it is suitable for heating the aerosol generating material in the devices of embodiments.

In some embodiments, it may be advantageous for the heating element to have high electrical conductivity; in other embodiments, it may be advantageous for it to have low electrical conductivity. This is because the electrical conductivity of the heating element dictates the electric current generated at any given voltage, which itself dictates two things: the rate at which the element emits heat, and the rate at which it consumes electricity.

In embodiments wherein the heating element has high electrical conductivity, the rate of heat emission will be high and the rate of electricity consumption will be high. This is because the current will be high, leading to the emission of more heat and the consumption of more electricity. In embodiments wherein the heating element has a low electrical conductivity, the rate of heat emission will be low and the rate of electricity consumption will be low. This is because the current will be low, leading to the emission of less heat and the consumption of less electricity.

In some embodiments, the heating element may have an electrical conductivity most appropriate for the device into which it is incorporated, taking into account how much electricity is available and how fast heat needs to be transferred to the aerosol generating material.

An electric current of any suitable size may be passed through the heating element in the devices of embodiments. In some embodiments, it may be advantageous to pass a high electric current through it because this will increase the rate of heat transfer to the aerosol generating material. In some embodiments, it may be advantageous to pass a low electric current through it because this will decrease the rate of electricity consumption. In some embodiments, an electric current may be passed through the heating element with a magnitude of between about 0.3-8 A, 2-6 A, or 4-6 A.

Any suitable means may be used to pass an electric current through the heating element in the devices of embodiments. The heating elements may be constantly in contact with the power source, or they may come into contact with the power source only when the device is in use and the aerosol generating material is to be heated. In other embodiments, the heating elements may be constantly in contact with the aerosol generating material, or they may come into contact with the aerosol generating material only when the device is in use and the aerosol generating material is to be heated. Creating contact may involve the relative movement of the elements.

In some embodiments, one or more batteries may be used to provide a potential difference and pass a direct electric current through the heating element. In these embodiments, one or more batteries may be connected to the heating element in any suitable way, for example by using of wires and/or clips. In embodiments wherein more than one battery is used to provide more than one power supply, the batteries may be the same or may be different.

A battery used in the devices of the invention may have any suitable properties. For example, it may be rechargeable or non-rechargeable and may be replaceable or non-replaceable.

A battery used in the devices of embodiments may have any suitable voltage. In some embodiments, a battery with a high voltage may be preferred over a battery with a low voltage because this will generate a higher electric current and the metal mesh will emit heat at a higher rate. In some embodiments, a battery incorporated into the devices of the invention has a voltage of between about 0.5-10 V, 2-8 V, or 4-6 V.

The voltage of a battery used in the devices may be chosen based on the size of the electric current which needs to pass through the heating element. In embodiments wherein the heating element has high electrical resistance, the battery may have a high voltage; in embodiments wherein the heating element has low electrical resistance, the battery may have a low voltage.

A battery used in the devices may have any suitable charge capacity. In some embodiments, a battery with a high charge capacity may be preferred over a battery with a low charge capacity because this will allow the battery to deliver a potential difference for a longer period of time.

One or more batteries may be connected to an electrical resistance heating element in the devices of embodiments via any suitable electronic circuit. In some embodiments, one or more batteries may be connected to more than one heating element in the device. In some embodiments, two or more heating elements may be provided with electricity from one or more batteries independently from one another. In some embodiments, two or more heating elements may be provided with electricity from one or more batteries sequentially.

The manner and extent to which the aerosol generating material is in contact with the heating element will also have an effect on the generation of the aerosol and/or gas upon heating the aerosol generating material.

The aerosol generating material may contact the heating element in any suitable way, provided that the temperature of the heating element is sufficient to heat the aerosol generating material to form an aerosol. In at least some embodiments, the temperature is not so high so as to combust the aerosol generating material.

In some embodiments, the heating element may be at least partially embedded in, or coated by, the aerosol generating material. In some embodiments, the heating element may be in the form of a mesh and the aerosol generating material may be coated onto the mesh. In some embodiments, the heating element may be in the form of a coil and the aerosol generating material may be coated onto the coil.

In some embodiments, it may be advantageous for the majority or whole of the heating element to be embedded in, or coated by, the aerosol generating material because this will improve the efficiency of heat transfer from the heating element to the aerosol generating material.

In some embodiments, the aerosol generating material may be at least partially surrounded by the heating element. In some of these embodiments, some or all of the aerosol generating material in the devices of the invention may be in the form of a monolith. In embodiments wherein the aerosol generating material is in the form of a monolith, it may have been formed by a process comprising extrusion.

In some embodiments, the heating element may be in the form of a mesh and may be wrapped around some or all of the aerosol generating material. In some embodiments, the heating element may be in the form of a coil and may be wrapped around some or all of the aerosol generating material. In some of these embodiments, some or all of the aerosol generating material may be positioned at the centre of a metal coil.

Referring to FIG. 1, for the purpose of illustration and not limitation, there is provided a sheet 1 comprising aerosol generating material 3 coated onto a metal mesh 2 according to an exemplary embodiment of the present disclosure. According to this exemplary embodiment, the majority of the metal mesh 2 is embedded in the aerosol generating material 3.

Figure 2:
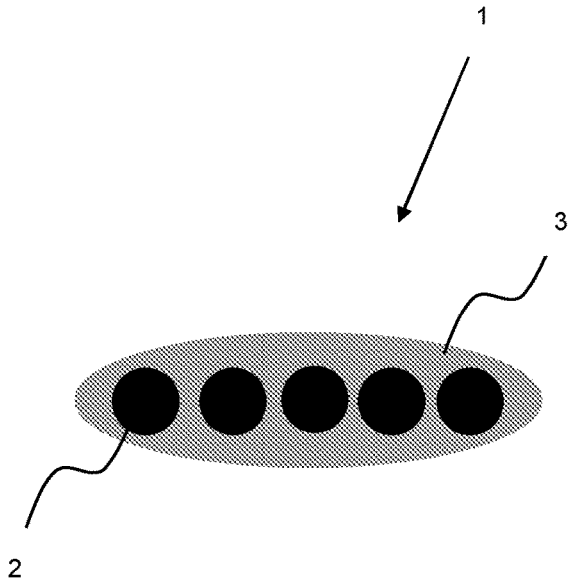
FIG. 2 is a schematic illustration of the cross section of aerosol generating material coated onto a metal mesh heating element according to one embodiment (not drawn to scale).

Referring to FIG. 2, for the purpose of illustration and not limitation, there is provided a sectional view of the sheet 1 comprising aerosol generating material 3 cast onto a metal mesh 2, as shown in FIG. 1.

Figure 3:
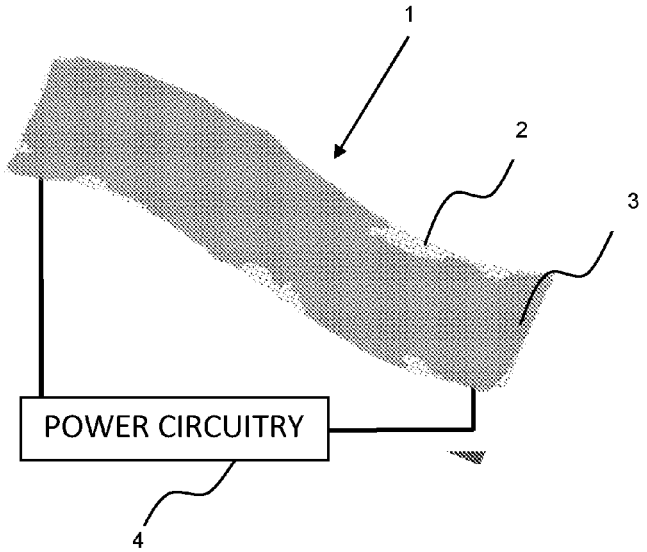
FIG. 3 is a schematic illustration of aerosol generating material coated onto a metal mesh heating element connected to a power source according to one embodiment (not drawn to scale).
Figure 4:
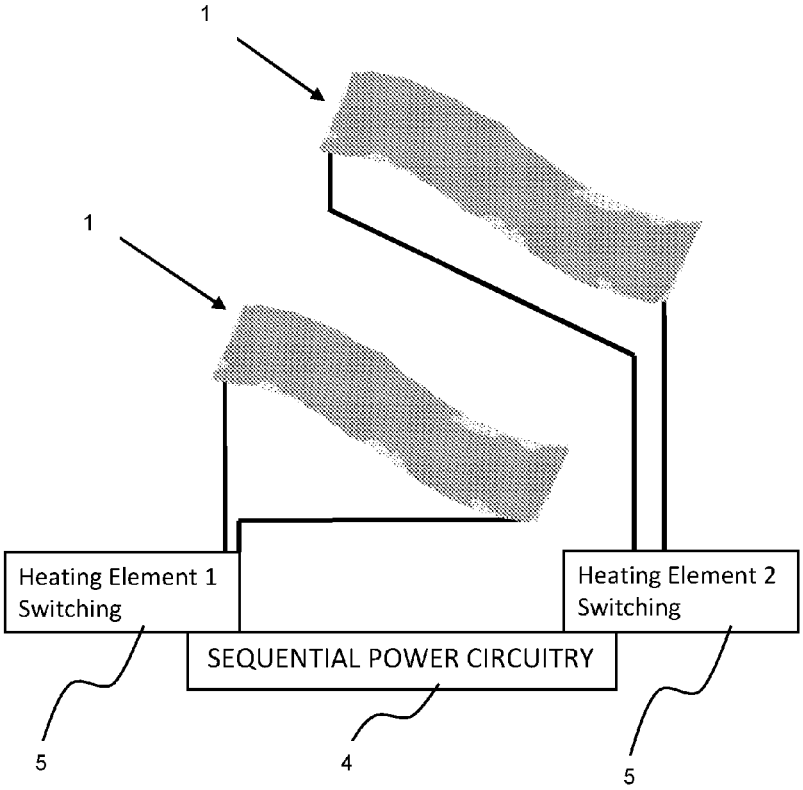
FIG. 4 is a schematic illustration of two metal mesh heating elements, each coated with aerosol generating material, connected to a sequential power source to enable separate sequential heating of each element according to one embodiment (not drawn to scale).

Referring to FIG. 3, for the purpose of illustration and not limitation, there is provided the sheet 1 comprising aerosol generating material 3 coated onto a metal mesh 2, as shown in FIG. 1, and connected to a power source 4. In FIG. 4, multiple sheets 1 are shown connected to a power source 4, with switching mechanisms 5 allowing the provision of electricity to each sheet 1 to be controlled.

Figure 5:
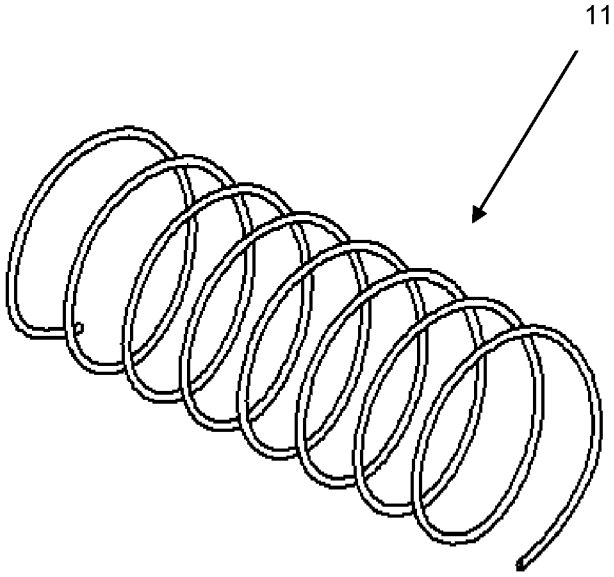
FIG. 5 is a schematic illustration of aerosol generating material coated onto a metal coil heating element according to one embodiment (not drawn to scale).
Figure 6:
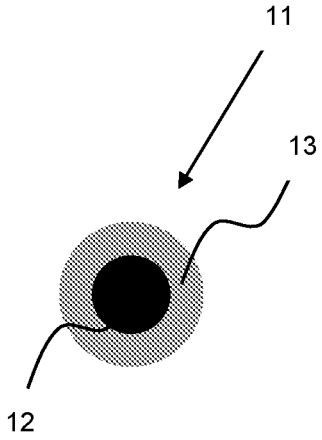
FIG. 6 is a schematic illustration of the cross section of aerosol generating material coated onto a metal coil heating element according to one embodiment (not drawn to scale).

Referring to FIG. 5, for the purpose of illustration and not limitation, there is provided a coated coil 11. As shown in cross section in FIG. 6, the coated coil 11 comprises aerosol generating material 13 coated onto a metal coil 12 according to one exemplary embodiment of the present disclosure.

Figure 7:
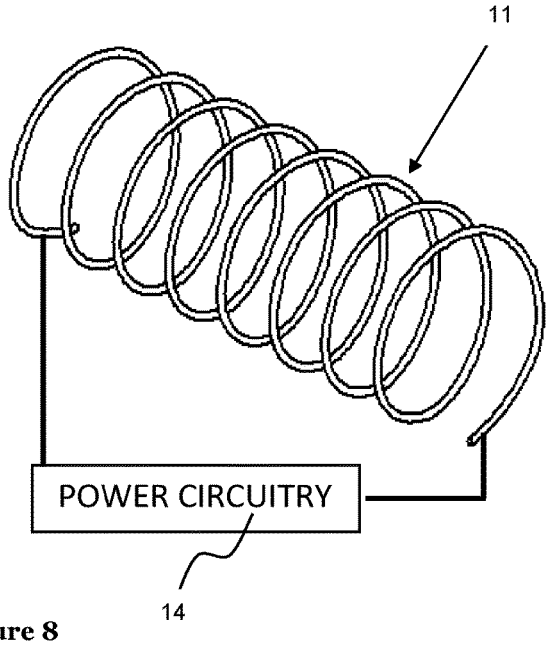
FIG. 7 is a schematic illustration of aerosol generating material coated onto a metal coil heating element connected to a power source according to one embodiment (not drawn to scale).
Figure 8:
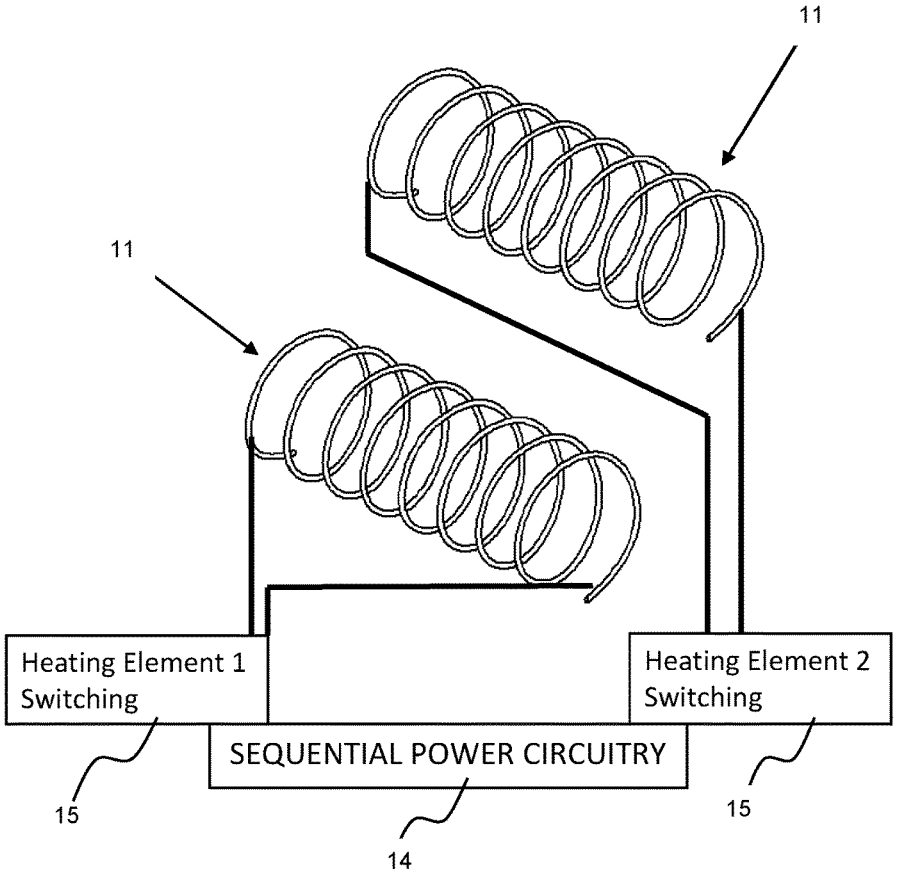
FIG. 8 is a schematic illustration of two metal coil heating elements, each coated with aerosol generating material connected to a sequential power source to enable separate sequential heating of each element according to one embodiment (not drawn to scale).

Referring to FIG. 7, for the purpose of illustration and not limitation, there is provided a coated coil 11, as shown in FIG. 5, connected to a power source 14. In FIG. 8, multiple coils 11 are shown connected to a power source 14, with switching mechanisms 15 allowing the provision of electricity to each coil 11 to be controlled.

Figure 9:
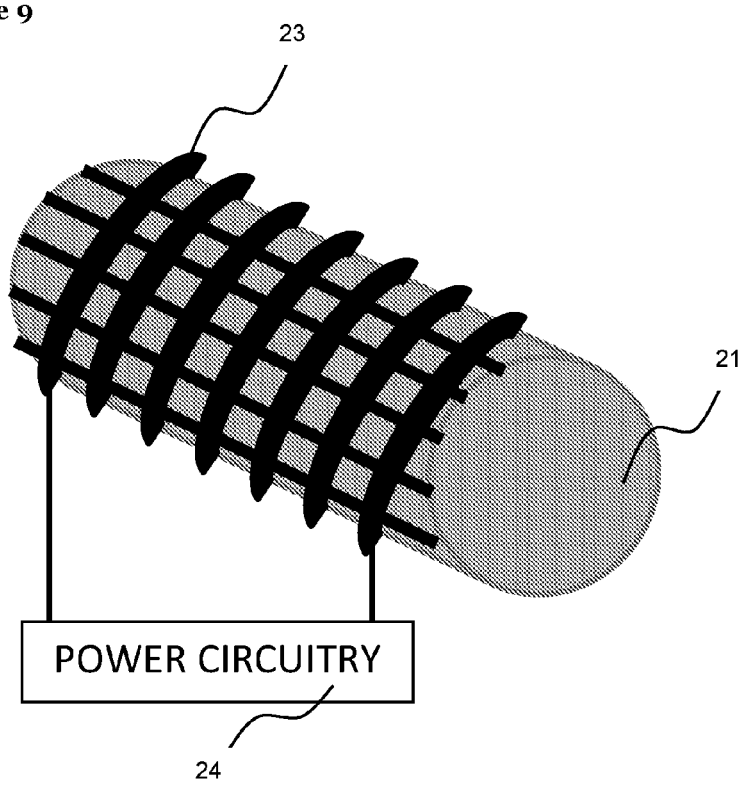
FIG. 9 is a schematic illustration of aerosol generating material surrounded by a metal mesh heating element connected to a power source according to one embodiment (not drawn to scale).

Referring to FIG. 9, for the purpose of illustration and not limitation, there is provided a monolith 21 of aerosol generating material with a metal mesh heating element 23 wrapped around it. The metal mesh heating element 23 is connected to a power source 24.

Figure 10:
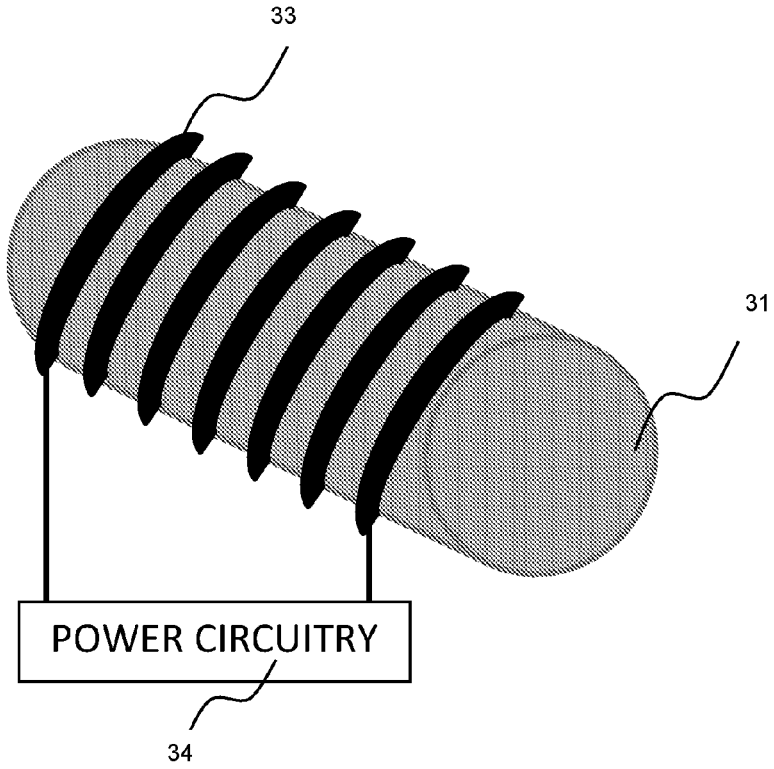
FIG. 10 is a schematic illustration of aerosol generating material surrounded by a metal coil heating element connected to a power source according to one embodiment (not drawn to scale).

Referring to FIG. 10, for the purpose of illustration and not limitation, there is provided a monolith 31 of aerosol generating material with a metal coil heating element 33 wrapped around it. The metal coil heating element 33 is connected to a power source 34.

In some embodiments, a first portion or section of the aerosol generating material may be heated by the heat source, such as an electrical resistance heating element, independently from a second portion or section of the aerosol generating material. In some of these embodiments, the first portion of the aerosol generating material may have a different chemical composition compared to the second portion of the aerosol generating material. This may allow for different aerosols and/or gases to be generated in the devices of the invention.

In some embodiments, different portions of the aerosol generating material may be able to generate different flavors, and/or provide different sensory experiences.

In some embodiments, the different portions of the aerosol generating material may be heated independently and/or sequentially. In some embodiments, the user of the device may be able to initiate and/or control which of the portions is heated, and so which aerosols and/or gases are generated.

In some embodiments, at least some of the aerosol generating material must be moved from a first position to a second position in the device in order to be heated by the heat source. In some of these embodiments, the aerosol generating material may be moved at the volition of the user of the device. In some embodiments, the movement will bring the electrical resistance heater into contact with a power source.

In some embodiments, the aerosol generating material comprises two or more portions and the aerosol generating material may be moved in order to facilitate the sequential heating of two or more portions of the aerosol generating material. For example, the movement may bring the electrical resistance heater associated with any given portion of aerosol generating material into contact with a power source.

In some embodiments, the electrical resistance heating element comprises two or more parts which are independently powered, to allow the portions of the aerosol generating material associated with those different parts of the heating element to be heated independently and/or sequentially. In some embodiments, the different parts of the electrical resistance heating element are independently powered by virtue of the parts having separate power sources, such as separate batteries. In some embodiments, the different parts of the electrical resistance heating element are independently powered by virtue of one or more switches linking the parts to a single power source.

Figure 15:
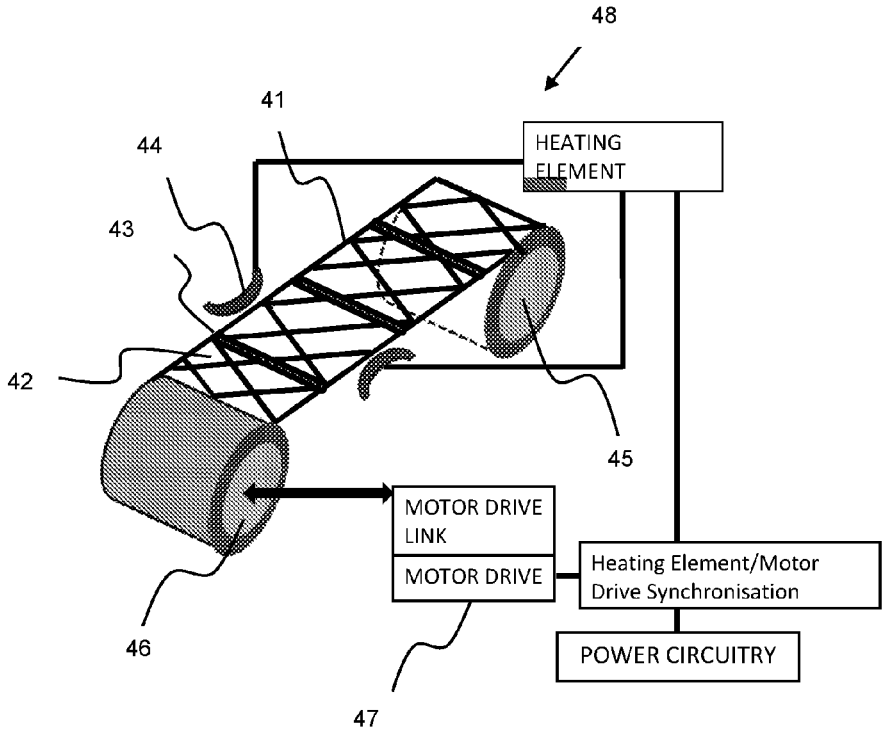
FIG. 15 is a schematic illustration of a coated heating element in a cassette format, with cassette drive to advance the element into a heating zone, connected to a power source (not drawn to scale).

Referring to FIG. 15, for the purpose of illustration and not limitation, there is provided a ribbon 41 comprising aerosol generating material cast onto a mesh acting as an electrical resistance heating element. The ribbon 41 comprises multiple portions 42 and is movable. The portions 42 are separated by an insulating means 43, such as an insulating strip, and each portion comprises a section of aerosol generating material encasing a section of heating element. The movement of the ribbon 41 sequentially brings a section of heating element into contact with the power source 44, for example a battery. This powers the heating element, heating the portion of aerosol generating material in contact with that portion of the heating element. The ribbon 41 must be moved to heat a new portion of the ribbon, bringing a new section of heating element into contact with the power source to heat the new section of aerosol generating material.

The ribbon 41 is wrapped around two spools 45, 46 one of which may be driven to move the ribbon. In some embodiments, the drive spool 46 may be turned manually. In other embodiments, it may be driven by a motor 47. Thus, the ribbon 41 and spools 45, 46 form a cartridge or "cassette" 48. The drive spool 46 may be rotated to wind the ribbon 41 onto the drive spool 46, resulting in the ribbon 41 being unwound from the other spool 45. In this way, the ribbon 41 may be moved, moving different portions 42 into alignment and/or contact with the power source 44.

Figure 16:
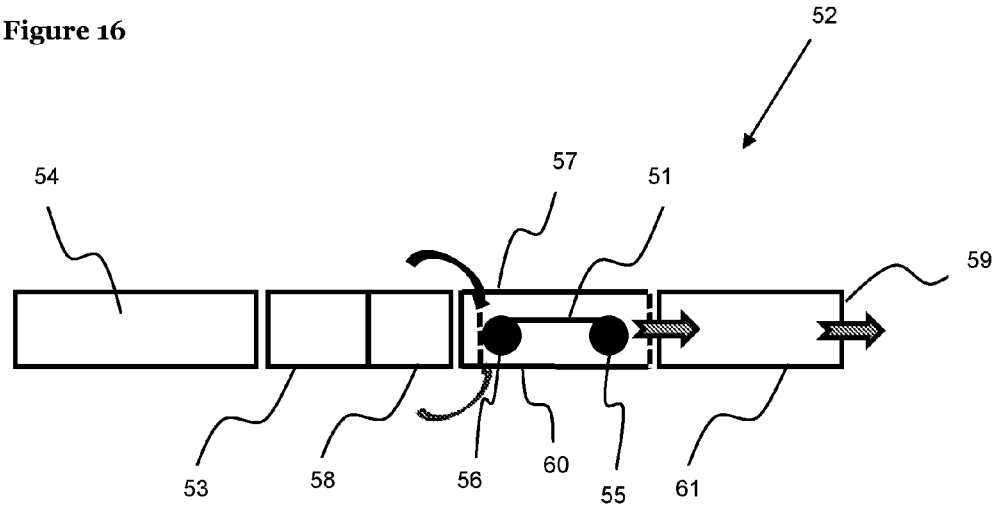
FIG. 16 is a schematic illustration of a smoking article incorporating a cassette aerosol generation chamber according to one embodiment (not drawn to scale).

Referring to FIG. 16, for the purpose of illustration and not limitation, there is provided a device according to one exemplary embodiment of the present disclosure. The device 52 comprises a cartridge 57 as shown in FIG. 15, comprising a ribbon 51 and spools 55, 56. The device further comprises a power source 54, control circuitry 53 to control the independent and sequential heating of the sections of the ribbon 51, and a cassette motor drive unit 58, which drives the drive spool 56. The device further comprises an aerosol formation chamber 61 in which aerosol from the heated aerosol generating material may form and be inhaled via a mouthpiece 59 of the device. The air flow through the device 52 is illustrated by the arrows. Ambient air enters via vents in the body or housing 60 of the device 52, flows past the cassette and the aerosol generating material being heated, picking up the gas and vapor generated by the heating. Then the air flow moves into the aerosol formation chamber 61 where the aerosol is formed. The aerosol, carried by the air flow, then exits the device via the mouthpiece 59. In some embodiments, the air flow may be generated by drawing or puffing on the device 52.

Figure 17:
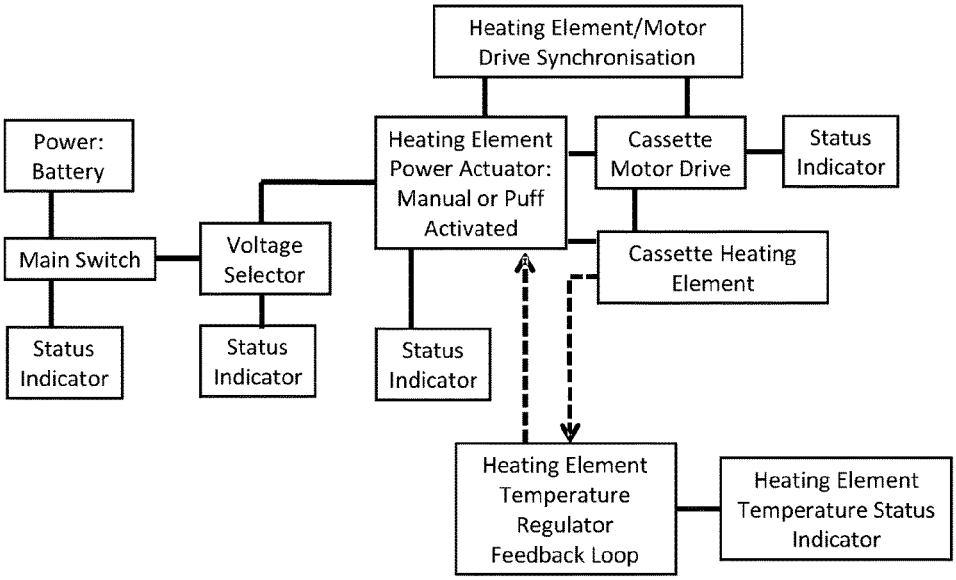
FIG. 17 is a schematic illustration of the circuit logic for the electrical heating element in a cassette format in the smoking article according to one embodiment (not drawn to scale).

Referring to FIG. 17, for the purpose of illustration and not limitation, there is provided an overview of the electronic circuitry used to control the generation of heat by the heat source in a device, such as the device shown in FIG. 16. A temperature regulator is included to prevent the heating elements becoming too hot. The circuitry provides for indicators to indicate various properties of the electronic device.

The aerosol generating material may be contacted by the electrical resistance heating element and incorporated into an aerosol generating device to form the devices of embodiments in any suitable way.

In some embodiments, the aerosol generating material may be contacted by the heating element before being incorporated into an aerosol generating device. In some embodiments, the aerosol generating material and heating element may be put into a device by the user. In some embodiments, the aerosol generating material and the heating element may be provided in a cartridge, and the cartridge may be inserted into a device. In some of these embodiments, this cartridge may be replaceable.

In embodiments wherein the aerosol generating material and the heating element are provided in a cartridge, the cartridge may have any suitable structure.

In some embodiments, the cartridge may comprise one or more areas on its surface for connecting the heating element of the cartridge to a power source in the device. In some embodiments, these areas may be covered by a cover, such as a cap, when the cartridge has not been added to the device. In some embodiments, the cartridge may comprise one or more orifices for the passage of air, gas, and/or aerosol. In some embodiments, these orifices may be covered by a cover, such as a cap, when the cartridge has not been added to the device.

In embodiments wherein the aerosol generating material and the heating element are provided in a cartridge, the cartridge may be combined with other parts of the aerosol generating device in any suitable way. In some embodiments, it may be attached to other parts of the device by friction fit and/or screw fit and/or press fit.

Figure 11:
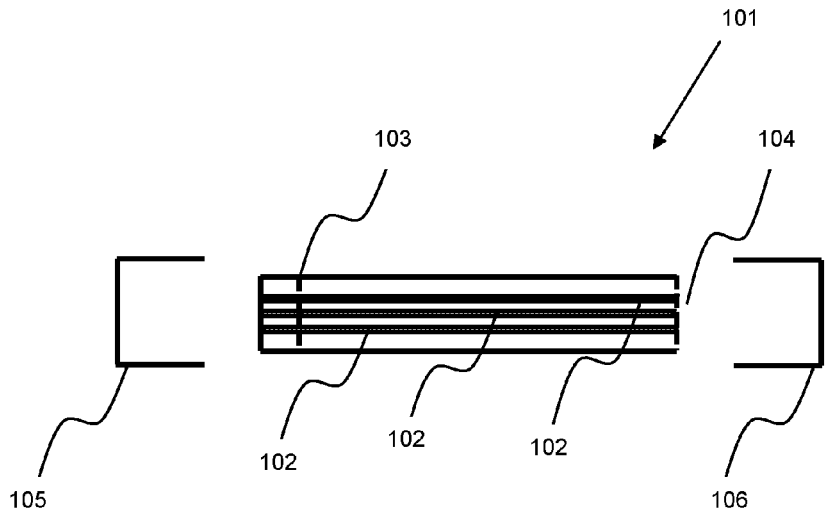
FIG. 11 is a schematic illustration of a sequential aerosol generation chamber including several heating elements comprising aerosol generating material, each of which individually may be in a sealed chamber, in a sealed capsule with electrical contacts for connection to a sequential power source to enable separate sequential heating of each element according to one embodiment (not drawn to scale).

Referring to FIG. 11, for the purpose of illustration and not limitation, there is provided a cartridge 101 according to one embodiment of the disclosure. This comprises three electrical resistance heating elements 102, which are coated with an aerosol generating material (not shown). These may be heated independently and sequentially. The cartridge 101 comprises air orifices 103. The cartridge optionally comprises two end caps 105, 106, which may be screwed or pressed into position on the ends of the cartridge 101. The end caps 105, 106 cover the electrical contacts of the heating elements 102 and the air orifices or vents 104.

Figure 12:
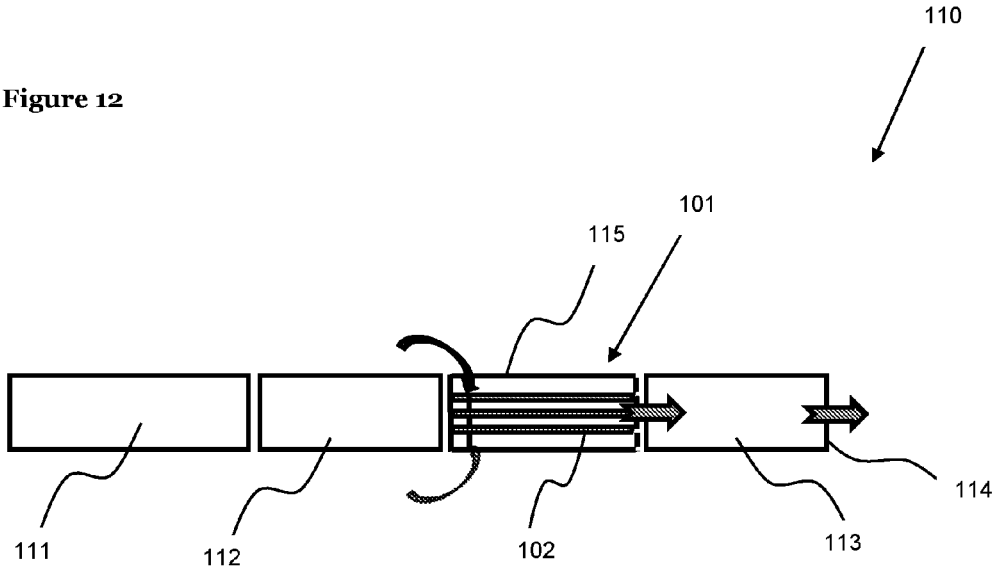
FIG. 12 is a schematic illustration of a smoking article incorporating a sequential aerosol generation chamber according to one embodiment (not drawn to scale).

Referring to FIG. 12, for the purpose of illustration and not limitation, there is shown a cartridge 101 (as shown in FIG. 11) incorporated into a device 110 according to one embodiment of the disclosure. The device 110 comprises a power source 111, such as a battery. The device 110 also comprises control circuitry 112 to control the independent and sequential heating of the heating elements 102 in the cartridge 101. The device 110 further comprises an aerosol formation chamber 113 in which aerosol from the aerosol generating material may form and be inhaled via a mouthpiece 114 of the device. The air flow through the device 110 is illustrated by the arrows. Ambient air enters via vents in the body or housing 115 of the device 110, flows past the cartridge 101 and the aerosol generating material being heated, picking up the gas and vapor generated by the heating. Then the air flow moves into the aerosol formation chamber 113 where the aerosol is formed. The aerosol, carried by the air flow, then exits the device 110 via the mouthpiece 114. In some embodiments, the air flow may be generated by drawing or puffing on the device 110.

Figure 13:
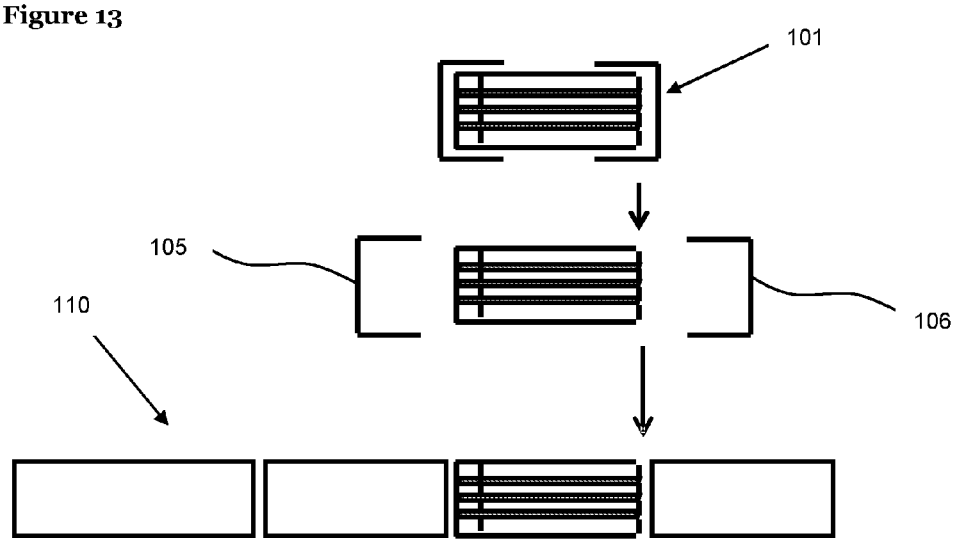
FIG. 13 is a schematic illustration of how the sequential aerosol generation chamber may be inserted into the smoking article (not drawn to scale).

Referring to FIG. 13, for the purpose of illustration and not limitation, there is shown a cartridge 101 (as shown in FIG. 11) incorporated into the device 110 shown in FIG. 12. The end caps 105, 106 are removed from the cartridge 101 before the cartridge 101 is inserted into the device 110 by a screw fit or a clamp fit mechanism.

Figure 14:
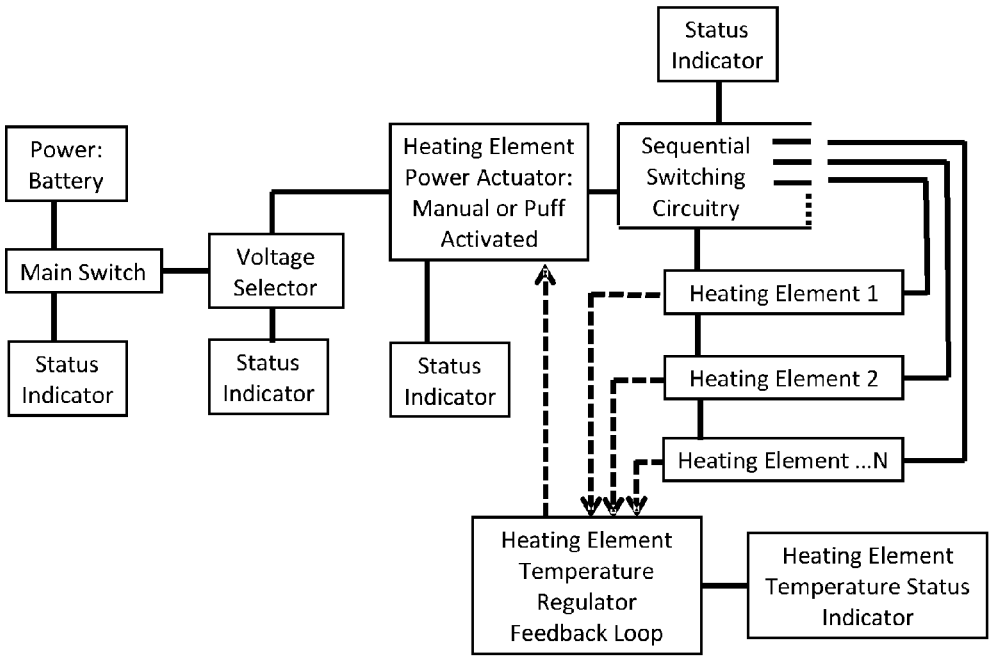
FIG. 14 is a schematic illustration of the circuit logic for the electrical heating element in the smoking article according to one embodiment (not drawn to scale).

Referring to FIG. 14, for the purpose of illustration and not limitation, there is provided an overview of the electronic circuitry used to control the generation of heat by the heating elements in the device, such as the device shown in FIG. 12. A temperature regulator is included to prevent the heating elements becoming too hot. The circuitry provides for indicators to indicate various properties of the electronic device.

The aerosol generating devices of embodiments may comprise any suitable components in addition to the aerosol generating material and the heat source, which may, for example, be an electrical resistance heating element.

In some embodiments, the devices may comprise an actuator, wherein the actuator may be actuated to initiate the heat source. In some embodiments, the actuator may initiate the passing of electricity through at least part of an electrical resistance heating element to generate heat. In some of these embodiments, the actuator may be, or be connected to, a switch in an electrical circuit. Alternatively or in addition, the actuator may be, or be connected to, an element for controlling the position of the aerosol generating material and/or heating element in the device.

In some embodiments, in addition or as an alternative to the device having an actuator, the heat source, such as an electrical resistance heating element, may be initiated when a pressure gradient is produced within the device. This pressure gradient may, for example, be produced when puffing on or inhaling through the device. In some embodiments, the electrical resistance heating element may be heated when puffing or inhaling.

In some embodiments, the device may comprise an indicator, wherein the indicator indicates one or more properties of the heating element and/or aerosol generating material. For example, the device may comprise an indicator for indicating the temperature of the electrical resistance heating element and/or aerosol generating material. For example, the device may comprise an indicator for indicating the extent to which the aerosol generating material has released an aerosol and/or gas.

In some embodiments, the device may comprise temperature controlling feedback circuitry to regulate the temperature of the heating element. This may be used to provide the optimum temperature for aerosol generation by heating.

In some embodiments, the device may comprise an insulating layer between the outside of the device and the electrical resistance heating element.

Any suitable process may be used to provide an aerosol generating material in contact with a heat source. In some embodiments, the aerosol generating material is separate to the heat source, and is brought into physical contact either upon assembly of the devices of the invention or upon use thereof. For example, in some embodiments, the aerosol generating material is provided in a monolithic form which is brought into contact with the heat source. To maximize the contact between the aerosol generating material and the heat source, the heat source may partially surround the aerosol generating material, contacting its outer surface. The monolithic form of the aerosol generating material may be formed by casting or extrusion or any other suitable method.

In other embodiments, the aerosol generating material and heat source are combined, for example in the form of a composite article. In such embodiments, the heat source may be coated with and/or embedded in aerosol generating material.

According to a second aspect, there is provided a method for fabricating the aerosol generating devices of the disclosure, wherein the method comprises applying a slurry of aerosol generating material to a heat source, such as an electrical resistance heating element. In some embodiments, this involves coating a slurry of aerosol generating material onto a heat source and/or dipping the heat source into a slurry of aerosol generating material. In other embodiments, this involves extruding a slurry of aerosol generating material onto the heat source, or co-extruding the slurry of aerosol generating material with the heat source.

Any suitable process or processes may be used to prepare the heat source and the slurry of aerosol generating material before combining them. In some embodiments, the heat source may be an electrical resistance heating element such as a metal mesh or coil. In some embodiments, the aerosol generating material is formed from a slurry which is applied to the heat source and then allowed to dry. In some embodiments, the aerosol generating material, and the slurry used to prepare it, comprise a tobacco material.

In some embodiments, the aerosol generating material is prepared by a method comprising the formation of a slurry. To form the slurry, the components of the aerosol generating material may be added in any suitable order. In embodiments wherein the aerosol generating material comprises tobacco extract, water, sodium alginate, and glycerol, the tobacco extract may be added to the water before the addition of sodium alginate and then glycerol. In some embodiments, the slurry may undergo mixing during and/or after the addition of its components and, in these embodiments, may undergo mixing for any suitable length of time. The length of time over which the slurry undergoes mixing will depend on its composition and volume, and may be varied accordingly. In some embodiments, the slurry may undergo mixing as necessary to make the composition of the slurry substantially homogeneous before being combined with a heat source to form a composite article.

In some embodiments, the slurry may be formed by first adding tobacco extract to water and mixing for about 30 seconds, before adding sodium alginate very slowly to prevent the slurry forming a vortex, mixing the composition for about 10 minutes, and then adding glycerol. In some embodiments, the slurry may then undergo further mixing, and may undergo further mixing for any suitable length of time. In some embodiments, the slurry may undergo further mixing for about 1-20 minutes, such as about 5 minutes.

In some embodiments, the slurry of aerosol generating material may be formed by a process comprising adding one or more additives, such as flavorants.

Once the slurry of aerosol generating material has been prepared and, if appropriate, the heat source has been made or prepared, they are combined. In some embodiments, they may be combined by casting the slurry of an aerosol generating material onto the heat source and/or dipping the heat source into the slurry. In some embodiments, they may be combined by extruding a slurry of aerosol generating material onto the heat source, or co-extruding the slurry of aerosol generating material with the heat source. In some embodiments, the heat source is an electrical resistance heating element, such as a mesh or coil.

In embodiments wherein the slurry of aerosol generating material is cast onto the heat source, the heat source may be placed onto a plate before the slurry is poured onto it. In some embodiments, the slurry may be poured onto the heat source so that it is evenly spread over the heat source with any suitable thickness or depth. In some embodiments, the slurry may be poured onto the heat source so that it has a thickness or depth of about 0.5-5 mm, 0.6-4 mm, 0.7-3 mm, 0.8-2 mm, or 0.9-2 mm. In some embodiments, the slurry may be poured onto the heat source so that it is spread evenly and has a thickness or depth of about 1 mm.

After being combined with the heat source, the slurry may be dried, and may be dried using any suitable method of drying. In some embodiments, the slurry may be dried in warm air (i.e. an oven). In these embodiments, the slurry may be dried at any suitable temperature for any suitable length of time. In some embodiments, the slurry may be dried at a temperature of about 40-90° C., or 50-80° C. In some embodiments, the slurry may be dried at a temperature of about 60° C. or 80° C. In some embodiments, the slurry of tobacco material may be dried for about 30-120 minutes, or 60-120 minutes.

In some embodiments, the slurry may be dried at a temperature of about 60° C. for about 70 minutes. In other embodiments, the slurry may be dried at a temperature of about 80° C. for about 110 minutes. Experiments have shown these conditions to result in the fabrication of composite sheets with properties suitable for the devices of the disclosure.

In embodiments wherein the slurry of aerosol generating material has been cast onto the heat source on a plate, the resulting composite structure may be removed from the plate.

In some embodiments, the composite structure may be removed using an item for accessing the space between structure and the plate, such as a knife. Alternatively or in addition, the composite structure may be removed by increasing the temperature of the contact point between the structure and the plate, such as by using steam.

In some embodiments, the composite structure may be conditioned after being removed from the plate. In some embodiments, the composite structure may be conditioned at about a temperature of about 20-25° C., such as about 22° C. Alternatively or in addition, the composite structure may be conditioned in air with a relative humidity of about 50-80%, such as about 60%. Alternatively or in addition, the composite structure may be conditioned for a length of time of about 6-24 hours, such as about 12 hours. In some embodiments, the composite structure may be conditioned at about 22° C. in air with a relative humidity of about 60% for about 12 hours.

In some embodiments, the composite structure may then be stored at a temperature of about ambient temperature at any suitable humidity for any suitable length of time, before being incorporated into the device of the invention. This may help to strengthen the composite structure.

Once the slurry of aerosol generating material has been combined with the heat source, dried, conditioned, and stored, the resulting composite structure may be divided into separate portions. These separate portions may then be incorporated into one or more devices. In some of these embodiments, the composite structure may be in the form of a sheet or strip and may be cut into separate portions using any suitable method of cutting. In other embodiments, the composite structure may be divided into portions by the inclusion of insulating means between adjacent portions, such as, for example, insulating strips.

According to a third aspect, there is provided the use of a device according to the disclosure for the generation of a gas and/or aerosol comprising nicotine.

In some embodiments, the devices may be used to generate a gas and/or aerosol which comprises one or more other substances besides nicotine. For example, the devices may be used to generate a gas and/or aerosol which comprises one or more flavorants and/or diluents. In some embodiments, the devices may be used to generate a nicotine-containing aerosol with suitable sensory characteristics.

In some embodiments, the device in use may be a heat not burn device.

According to a fourth aspect, there is provided the use of an aerosol generating material as defined in the first aspect for the generation of an aerosol and/or gas, comprising nicotine, by heating in contact with a heat source, such as an electrical resistance heating element.

According to a fifth aspect, there is provided a composite structure comprising a heat source, such as an electrical resistance heating element, which is at least partially embedded in, or coated by, the aerosol generating material as defined in the first aspect of the invention. Examples of such structures are illustrated in FIGS. 1 and 5.

According to a sixth aspect, there is provided a cassette comprising a composite structure according to the fifth aspect of the invention, and a means for moving the composite structure to allow different portions thereof to be heated. An example of such a cassette is illustrated in FIG. 15. Such a cassette may, in some embodiments, be inserted into a device comprising a power source, such as a battery, and electrical connectors which will contact the composite structure.

EXAMPLES

In the Examples, "Solids" and "Solid(s) Content" refers to the whole of the extract or slurry other than the water, and may include components which by themselves are liquid at room temperature and pressure, such as glycerol.

In the Examples, Reverse Osmosis [RO] quality water refers to softened water which is additionally purified by reverse osmosis.

Example 1: Tobacco Extraction and Extract Composition 4.5 kg of cut rag Virginia tobacco blend was extracted with 80 kg water (Reverse Osmosis [RO] quality) at 60° C. for 25-30 minutes with gentle agitation. The resulting mixture was filtered and the extract concentrated to the desired solids content range of 45-60% utilizing an evaporative concentration process. Table 1 shows the composition of the resulting tobacco extract.

TABLE 1

| Ingredient | % weight/weight |
|---|---|
| Solids | 53.10 |
| Nicotine | 3.56 |

This tobacco extract was utilized to make an aerosol generating material as described in Example 2.

Example 2: Aerosol Generating Material—Manufacturing Procedure and Composition Making an aerosol generating material comprising a tobacco extract involved binding the tobacco extract with an aerosol generating agent, such as glycerol, utilizing a hydrocolloid binding agent. The resulting gel was then coated onto a metal mesh heating element. The gel formed and set on the metal mesh by a combination internal cross-linking and drying, resulting in a layer of aerosol generating material applied to or bound to the heating element.

The aerosol generating material was prepared utilizing the following procedure. Water (RO quality, 201 g) was added to tobacco extract (339 g, 53.1% solids content) in a high shear mixer. Sodium alginate powder (60 g) was slowly added to this mixture whilst pulsing the high shear mixer to ensure even distribution of the alginate powder. To fully hydrate the alginate after the addition stage was completed, the high shear mixer was switched to continuous mixing for 10 minutes. During this process, the mixture thickened to form a gel-like consistency. Glycerol (37 g) was added to the slurry, and mixed for 5 minutes.

The resulting material formed a thick but fluid slurry. The slurry solids content was 43.49%. This slurry was cast directly onto a stainless steel mesh, which was placed on a supporting metal plate to assist the casting process. The stainless steel mesh had strands of metal with an outer diameter of 0.17 mm, and a mesh size of 40. This was placed in a pre-heated oven at 80° C. for 113 minutes. The dried aerosol generating material was allowed to cool. It appeared as a coherent, cohesive sheet adhered to the metal mesh. The composition of the aerosol generating material is shown in Table 2.

TABLE 2

| Component | Component Weight (g) | Component Solid Content (g) | Material Solid Composition (% dry weight) |
|---|---|---|---|
| Tobacco Extract | 339 | 180 | 64.98 |
| Alginate | 60 | 60 | 21.66 |

TABLE 2-continued

| Component | Component Weight (g) | Component Solid Content (g) | Material Solid Composition (% dry weight) |
|---|---|---|---|
| Water | 201 | 0 | 0 |
| Glycerol | 37 | 37 | 13.36 |
| Total | 637 | 277 | |

The aerosol generating material coated onto the steel mesh formed a composite sheet structure which was removed from the supporting plate, with steam assistance if required, utilizing a cutting blade.

Strips of the stainless steel mesh coated with aerosol generating material were cut to the following dimensions:

1 cm width×5 cm length 1 cm width×3.5 cm length 0.8 cm width×5 cm length

The aerosol generation capacity versus the electrical power applied, and temperatures attained using this composite material, were investigated in Example 3.

Example 3: Aerosol Generation Utilizing Electrical Power

The procedure involved applying electrical connector 'spring crocodile clips' to the peripheries of the coated stainless steel mesh and ensuring good electrical contact. The steel mesh acted as a heating element providing a heat source to the aerosol generating material, causing aerosol and/or gas formation. The electrical power source was a HAMEG, HMP4030. The temperature of the heated coated stainless steel mesh was measured using a thermal imaging camera, FLUKE Ti32.

Aerosol generation in this case was observed visually as a mist arising from the coated mesh. In addition an aroma reminiscent of wet, warm tobacco was detected. The electrical power applied and temperatures measured are presented in Table 3.

TABLE 3

| Material | Current (A) | Temperature (° C.) | Observation |
|---|---|---|---|
| 1 cm width × 5 cm length | 4 | 100-130 Highest temperature close to electrical contacts | Visible aerosol mist observed |
| 1 cm width × 3.5 cm length | 5 | 160-180 Highest temperature close to electrical contacts | Visible aerosol mist observed |
| 0.8 cm width × 5 cm length | 3 | 150-180 Highest temperature (ca. 213° C.) close to electrical contacts | Visible aerosol mist observed |

Example 4: Tobacco Extraction, Manufacture of Aerosol Generating Material and Electrically Powered Aerosol Generation Herein is exemplified a procedure which describes a complete process of producing tobacco extract, the manufacture of an aerosol generating material from tobacco extract, and the electrically powered generation of an aerosol therefrom. The process comprises:

(i) Preparation of a water extract from tobacco (Tobacco Extraction Procedure)

(ii) Preparation of an aerosol generating material from the tobacco extract (Aerosol Generating Material Manufacture)

(iii) Generation of an atmospheric aerosol from the aerosol generating material utilizing an electrically powered heating element (Atmospheric Aerosol Generation via Electrically Heated Element)

In addition, the quantities of selected substances transferred from the aerosol generating material to produce the free atmospheric aerosol resulting by heating via the electrically powered heating element have been measured, and an estimate of percentage transfer of the selected substances has been calculated.

Example 4 (i): Tobacco Extraction Procedure 3.0 kg of cut rag Burley tobacco blend was extracted with 80 kg water (RO quality) at 60° C. for 25-30 minutes with gentle agitation. The resulting mixture was filtered and the extract concentrated to the desired solids content in the range of 45-60% utilizing utilising an evaporative concentration process. Table 4 shows the composition of the resulting tobacco extract.

TABLE 4

| Composition of Tobacco Extract | |
|---|---|
| Ingredient | % weight/weight |
| Solids | 41.80 |
| Nicotine | 2.77 |

This material was utilized to make the tobacco extract based aerosol generating material as described in Example 4 (ii).

Example 4 (ii): Aerosol Generating Material Preparation

The principle utilized to make the aerosol generating material is similar to that described in Example 2.

The tobacco extract based aerosol generating material was prepared utilizing the following procedure.

Tobacco extract (200.93 g, 41.8% solids content) was placed in a high shear mixer. Sodium alginate powder (27.7 g) was slowly added to this mixture whilst pulsing the high shear mixer to ensure even distribution of the alginate powder. To fully hydrate the alginate after the addition stage was completed, the high shear mixer was switched to continuous mixing for 10 minutes. During this process, the mixture thickened to form a gel-like consistency. Glycerol (20.62 g) was added to the slurry, and mixed for 5 minutes.

The resulting material formed a thick but fluid slurry. The slurry solids content was 53.09%. The slurry was cast directly onto stainless steel mesh strips, which were placed on a supporting metal plate to assist the casting process. This was placed in a pre-heated oven at 70° C. for 290 minutes. The dried aerosol generating material was allowed to cool. It appeared as a coherent, cohesive sheet adhering to the metal mesh. The composition of the aerosol generating material is shown in Table 5.

TABLE 5

Composition of Tobacco Extract Aerosol Generating Material

| Component | Component Weight (g) | Component Solid Content (g) | Material Solid Composition (% dry weight) |
|---|---|---|---|
| Tobacco Extract | 200.93 | 84.00 | 63.5 |
| Alginate | 27.70 | 27.70 | 20.9 |
| Glycerol | 20.62 | 20.62 | 15.6 |
| Total | 249.25 | 132.32 | |

The aerosol generating material coated onto the steel mesh formed a structure which was removed from the supporting plate, with steam assistance if required, utilising a cutting blade.

This aerosol generating material was analyzed for water, nicotine and glycerol content and the results are shown in Table 6.

TABLE 6

Aerosol Generating Material Analysis

| Component | Nicotine (mg/g) WWB | Nicotine (mg/g) DWB | Glycerol (mg/g) WWB | Glycerol (mg/g) DWB | Water (%) |
|---|---|---|---|---|---|
| | 25.67 | 31.95 | 87.51 | 108.89 | 19.64 |

Note:
WWB: Wet Weight Basis;
DWB: Dry Weight Basis

Strips of wire mesh, of approximate dimensions 4.5 cm length, 1.0 cm width were coated to demonstrate good coherence of the aerosol generating material to the wire mesh. However, these were not used for generating an aerosol in this experiment. To demonstrate the versatility of the material, the aerosol generating material was molded around nichrome wire coils which were designed to act as heating elements as an alternative format to stainless steel mesh heating elements. These elements were assembled in an aerosol generation test rig apparatus to investigate aerosol generation propensity as described in Example 4 (iii).

The aerosol generation capability of the aerosol generating material versus the electrical power applied and temperature attained was investigated.

Figure 18:
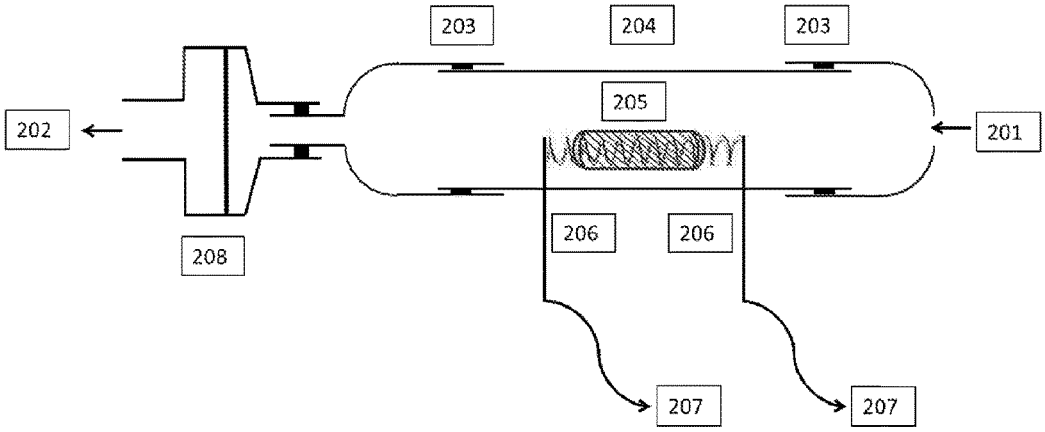
FIG. 18 is a schematic illustration of an aerosol generation test rig apparatus for evaluation of aerosol generation propensity (not drawn to scale).

Example 4 (iii): Atmospheric Aerosol Generation Via Electrically Heated Element The aerosol generation test rig apparatus used to assess aerosol generation propensity of the aerosol generating material in this Example comprised of a glass tube with removable glass end pieces into which penetrated two tungsten rods via glass to metal seal welds, which acted as electrodes. The equipment is illustrated in FIG. 18 and component parts as follows:

201 Air intake

202 Smoking machine or continuous draw pump

203 Removable glass end piece: 40/38 ground glass joint connection

204 Glass tube (19 cm length×3.5 cm diameter)

205 Heating element (coil geometry illustrated) coated with aerosol generating material: connected to electrodes

206 Electrodes (tungsten rods) penetrating glass via glass-metal seal welds

207 Connectors to electrical power supply

208 Cambridge filter holder with particle filter.

The aerosol generating material was assessed for aerosol generation propensity in two "smoking regimes":

Run 1: 80 ml puff volume over 3 seconds every 30 seconds;

Run 2: air continuously drawn over the heated coil coated with aerosol generating material at a rate of 2.5 l/s.

In both experimental runs, the specifications of the nichrome wire and dimensions of the coil heating elements were the same, as indicated in Table 7.

TABLE 7

Nichrome Wire Specification and Heating Coil Dimensions

| | |
|---|---|
| Nichrome Wire Specification | Nickel (80%); Chromium (20%) |
| Standard Wire Gauge (SWG) | 35 (0.2134 mm diameter) |
| Length of Wire to Form Coil (cm) | 50 |
| Coil Inner Diameter (mm) | 3.5 |

Run 1

The element, a coil of nichrome wire of specification shown in Table 7, incorporated 0.41 g of aerosol generating material deposited in contact with the heating coil wire.

The procedure involved applying electrical connector 'spring crocodile clips' to the extremities of the nichrome coil incorporating the aerosol generating material (the extremities were not coated) ensuring a good contact. The glass end pieces were removed from the aerosol generation test rig apparatus and each extremity of the aerosol generating material/electrically heated coil assembly secured to a respective tungsten electrode that penetrated the glass tube, such that good electrical contact resulted. The glass end caps were reassembled to the tube, and a Cambridge filter holder with particulate filter positioned as shown in FIG. 18, to which a smoking machine was attached.

External to the glass tube, a power supply was connected to the tungsten rods protruding outside the glass tube in order to supply electrical power to heat the coil and aerosol generating material located inside the glass tube (FIG. 18).

The electrical power source was a Weir Model 413D. The temperature of the heated coated coil was measured using a thermal imaging camera (FLUKE Ti32).

The smoking engine was switched on to draw air through the apparatus. The electrical power was switched on and the current and temperature at the surface of the aerosol generating material were measured and recorded. During the inter-puff period (30 seconds) a white dense opaque aerosol was generated in the apparatus enclosure within which the aerosol generating material/heating coil assembly was housed, and was seen to be escaping from the open end of the test rig. The quantity of aerosol generated was estimated by analyzing the deposition on the inside surfaces of the test rig glass tube and that trapped on a Cambridge filter pad (within a Cambridge filter holder) through which the aerosol was drawn via the smoking engine. The experiment was designed specifically to measure the aerosol deposited on the Cambridge filter pad and did not assess any penetration through the filter pad. The data for the quantities of selected substances in the resulting aerosol generated are shown in Table 8.

TABLE 8

| Quantities of Aerosol Substances Generated | | | |
|---|---|---|---|
| Sample | Nicotine (mg) | Glycerol (mg) | Water (mg) |
| Aerosol | 5.04 | 13.81 | 20.70 |

Table 9 below indicates the percentage transfer of nicotine, glycerol and water from the aerosol generating material to the aerosol following the application of electrical power, together with the current passed and the surface temperature of the aerosol generating material encasing the electrically heated coil element.

TABLE 9

| Percentage Transfer of Selected Substances to Form Aerosol | | | | | |
|---|---|---|---|---|---|
| Aerosol Generating Material | Current Applied | Measured Temperature at Surface of Aerosol Generating Material | Percentage Transfer of Analytes from Aerosol Generating Material to Aerosol | | |
| Weight (g) | (A) | (° C.) | Nicotine | Glycerol | Water |
| 0.41 | 0.5 | 85 | 47.9 | 38.5 | 25.7 |

It should be noted that, in this run, the aerosol deposits on the walls were included in the analysis. However, a proportion of the analytes may be in the gas phase and hence may penetrate the Cambridge filter, which is designed to trap particle phase aerosol components. Also, some aerosol was seen escaping from the open end of the test rig. These factors would result in a lower measurement of aerosol analyte levels, and hence a lower estimation of the transfer from the aerosol generating material on heating.

Run 2

The element, a coil of nichrome wire of specification shown in Table 7 (the same as in Run 1), incorporated 0.48 g of aerosol generating material deposited in contact with the heating coil wire.

The same rig and procedure used in Run 1 were performed in Run 2, with the exception of a continuous suction mode of 2.5 L/s of air over the aerosol generating material/heating coil assembly. Using this procedure, the aerosol was drawn onto the Cambridge filter pad trapping the aerosol. The data from Run 2 are shown in Table 10.

TABLE 10

| Quantities of Aerosol Substances Generated | | | |
|---|---|---|---|
| Sample | Nicotine (mg) | Glycerol (mg) | Water (mg) |
| Aerosol | 5.39 | 12.46 | 13.63 |

Table 11 below indicates the percentage transfer of nicotine, glycerol and water from the aerosol generating material to the aerosol following the application of electrical power, together with the current passed and the surface temperature of the aerosol generating material encasing the electrically heated coil element.

TABLE 11

| Percentage Transfer of Selected Substances to Form Aerosol | | | | | |
|---|---|---|---|---|---|
| Aerosol Generating Material | Current Applied | Measured Temperature at Surface of Aerosol Generating Material | Percentage Transfer of Analytes from Aerosol Generating Material to Aerosol | | |
| Weight (g) | (A) | (° C.) | Nicotine | Glycerol | Water |
| 0.48 | 0.5 | 97 | 43.7 | 29.7 | 14.5 |

It should be noted that, in this run, the aerosol deposits on the walls were not included in the analysis. Also, a proportion of the analytes may be in the gas phase in addition to the particle phase and hence may penetrate the Cambridge filter, which is designed to trap particle phase aerosol components. These two factors would result in a lower measurement of aerosol analyte levels, and hence a lower estimation of the transfer from the aerosol generating material on heating.

Discussion of Example 4

It can be seen that there is a substantial transfer of nicotine and glycerol from the aerosol generating material to form a free aerosol on application of electrical power heating to the heating element coil in both runs, even utilizing analytical techniques which potentially result in lower estimates. This shows conclusively that electrically powered heating applied to the aerosol generating material is sufficient to produce an aerosol with high nicotine and glycerol content. The data indicated that under these conditions, despite both substances having high boiling points, the transfer of nicotine is shown to exceed that of glycerol in both runs.

In order to address various issues and advance the art, the entirety of this disclosure shows by way of illustration various embodiments in which that which is claimed may be practiced and provide for superior aerosol generating devices. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A device for generating at least one of an inhalable aerosol or a gas, the device comprising:

an aerosol generating material having an integrated electrical resistance heating element, wherein the electrical resistance heating element is at least partially embedded in or coated by the aerosol generating material, so that the aerosol generating material may be heated in direct contact with the electrical resistance heating element, wherein the aerosol generating material is provided as at least one of a unitary structure or a coating which may be heated to generate multiple deliveries of at least one of an inhalable aerosol or a gas;

wherein the aerosol generating material is a cast or extruded material.

2. A device according to claim 1, wherein the aerosol generating material comprises nicotine.

3. A device according to claim 1, wherein at least part of the electrical resistance heating element is in the form of a mesh or a coil.

4. A device according to claim 1, wherein the aerosol generating material may be repeatedly heated by the heating element to generate deliveries of inhalable aerosol or gas.

5. A device according to claim 1, wherein the aerosol generating material comprises an aerosol generating agent.

6. A device according to claim 1, wherein the aerosol generating material comprises tobacco material.

7. A device according to claim 1, wherein the aerosol generating material comprises an inorganic filler material.

8. A device according to claim 1, wherein the aerosol generating material comprises a binder.

9. A device according to claim 1, wherein at least part of the aerosol generating material is at least partially surrounded by the electrical resistance heating element.

10. A device according to claim 1, wherein a first portion of the aerosol generating material may be heated independently from a second portion of the aerosol generating material by the electrical resistance heating element.

11. A device according to claim 10, wherein the first portion and the second portion have different chemical compositions.

12. A device according to claim 1, wherein at least one portion of the aerosol generating material must be moved from a first position to a second position in order to be heated by the electrical resistance heating element.

13. A device according to claim 1, wherein the heating of the aerosol generating material by the electrical resistance heating element is to be initiated or controlled by the user of the device.

14. A device according to claim 1, wherein the device is a heat-not-burn device.

15. A method for fabricating a device for generating at least one of an inhalable aerosol or a gas according to claim 1, wherein the method comprises applying a slurry of aerosol generating material to an electrical resistance heating element.

16. A method according to claim 15, wherein the slurry is applied by casting the slurry onto the electrical resistance heating element.

17. A method according to claim 15, wherein the slurry is applied by dipping the electrical resistance heating element into the slurry.

18. A method according to claim 15, wherein the slurry is extruded with or onto the electrical resistance heating element.

19. Use of a device according to claim 1 for the generation of at least one of an aerosol or a gas comprising nicotine.

20. Use of an aerosol generating material as defined in claim 1 for the generation of at least one of an aerosol or a gas comprising nicotine by heating the material in direct contact with an electrical resistance heating element.

21. A composite structure comprising:

an electrical resistance heating element, which is at least partially embedded in, or coated by, an aerosol generating material, wherein the material is in direct contact with the electrical resistance heating element and may be heated to generate multiple deliveries of at least one of an inhalable aerosol or a gas, wherein the aerosol generation material is a cast or extruded material.

22. A composite structure as claimed in claim 21, wherein the electrical resistance heating element is a mesh.

23. A composite structure as claimed in claim 21, wherein the structure may be moved to heat different portions of the structure.

24. A composite structure as claimed in claim 21, wherein different portions of the structure may be heated independently by separate power sources or by switching the supply of power from one portion to another.

25. A composite structure as claimed in claim 21, wherein the composite structure is in the form of an elongate ribbon or band.

26. A composite structure as claimed in claim 21, wherein the aerosol generating material is provided as a unitary structure or a coating and comprises nicotine.

27. An article comprising a composite structure as claimed in claim 21, and a means for moving the composite structure to allow different portions thereof to be heated.

28. An article as claimed in claim 27, wherein the composite structure is in the form of an elongate ribbon or band and the means for moving the composite structure is a spool.

* * * * *